US010344749B2

(12) United States Patent
Kawano et al.

(10) Patent No.: US 10,344,749 B2
(45) Date of Patent: Jul. 9, 2019

(54) HERMETIC COMPRESSOR AND REFRIGERATION DEVICE

(71) Applicant: PANASONIC APPLIANCES REFRIGERATION DEVICES SINGAPORE, Singapore (SG)

(72) Inventors: Hiroyuki Kawano, Shiga (JP); Noboru Iida, Shiga (JP)

(73) Assignee: PANASONIC APPLIANCES REFRIGERATION DEVICES SINGAPORE, Singapore (SG)

( * ) Notice: Subject to any disclaimer, the term of this patent is extended or adjusted under 35 U.S.C. 154(b) by 0 days.

(21) Appl. No.: 15/520,674

(22) PCT Filed: Mar. 18, 2016

(86) PCT No.: PCT/JP2016/001578

§ 371 (c)(1),
(2) Date: Apr. 20, 2017

(87) PCT Pub. No.: WO2016/152126

PCT Pub. Date: Sep. 29, 2016

(65) Prior Publication Data

US 2017/0306941 A1 Oct. 26, 2017

Related U.S. Application Data

(63) Continuation of application No. PCT/JP2016/001578, filed on Mar. 18, 2016.

(30) Foreign Application Priority Data

Mar. 25, 2015 (JP) ..... 2015-061861
Mar. 25, 2015 (JP) ..... 2015-061862
Dec. 25, 2015 (JP) ..... 2015-253865

(51) Int. Cl.
*F04B 39/02* (2006.01)
*F25B 1/02* (2006.01)
*F04B 35/04* (2006.01)
*F04B 39/00* (2006.01)
(Continued)

(52) U.S. Cl.
CPC ..... *F04B 39/02* (2013.01); *F04B 35/04* (2013.01); *F04B 39/0022* (2013.01);
(Continued)

(58) Field of Classification Search
CPC ..... F04B 39/02; F04B 49/20; F04B 39/0022; F04B 39/122; F04B 35/04; F04B 39/0094;
(Continued)

(56) References Cited

U.S. PATENT DOCUMENTS 4,718,830 A 1/1988 Middleton et al.
2004/0213682 A1* 10/2004 Seo ..... F04B 39/0027 417/363
(Continued)

FOREIGN PATENT DOCUMENTS

JP 2-169880 6/1990
JP 2013-545025 12/2013
(Continued)

OTHER PUBLICATIONS

International Search Report of PCT application No. PCT/JP2016/001578 dated Jun. 14, 2016, 4 pages.

*Primary Examiner* — Emmanuel E Duke
(74) *Attorney, Agent, or Firm* — Hamre, Schumann, Mueller & Larson, P.C.

(57) ABSTRACT

A hermetic compressor includes an electric motor element driving a compression element that includes a crankshaft including a main shaft, an eccentric shaft, and a flange, a cylinder block having a cylinder bore, and a piston configured to reciprocate in the cylinder bore. The crankshaft
(Continued)

further includes a communicating oil supply passage provided in the flange, a main shaft oil supply passage, and an eccentric shaft oil supply passage.

17 Claims, 15 Drawing Sheets

(51) Int. Cl.
*F04B 39/12* (2006.01)
*F04B 49/20* (2006.01)
*F25B 31/02* (2006.01)

(52) U.S. Cl.
CPC ..... *F04B 39/0094* (2013.01); *F04B 39/0246* (2013.01); *F04B 39/0253* (2013.01); *F04B 39/122* (2013.01); *F04B 49/20* (2013.01); *F25B 1/02* (2013.01); *F25B 31/023* (2013.01)

(58) Field of Classification Search
CPC ..... F04B 39/0261; F04B 39/0253; F04B 39/023; F25B 1/02
See application file for complete search history.

(56) References Cited

U.S. PATENT DOCUMENTS

2009/0092504 A1* 4/2009 Akashi ..... F04B 39/0246 417/368
2012/0100021 A1* 4/2012 Sato ..... F04B 39/023 417/415
2013/0309119 A1* 11/2013 Kim ..... F04B 39/0246 418/55.6
2013/0336765 A1 12/2013 Manke et al.
2015/0147203 A1* 5/2015 Kim ..... F04B 39/0253 417/372
2015/0322949 A1 11/2015 Oyagi et al.

FOREIGN PATENT DOCUMENTS

JP 2014202069 A * 10/2014
JP 2015-025363 2/2015
WO 2014/064919 5/2014

* cited by examiner

HERMETIC COMPRESSOR AND REFRIGERATION DEVICE

TECHNICAL FIELD

The present invention relates to a hermetic compressor having a crankshaft formed with an oil supply passageway, and also relates to a refrigeration device mounted with the hermetic compressor.

BACKGROUND ART

Among conventional hermetic compressors, there is a hermetic compressor that is provided with an oil supply passage configured for communication between a cylindrical surface of an eccentric shaft and a cylindrical surface of a main shaft for the purpose of using a crankshaft having small shaft diameters and an increased amount of eccentricity (refer to, for example, PTL 1).

A description is provided of the conventional hermetic compressor described in PTL 1.

FIG. 13 is a longitudinal sectional view of the conventional hermetic compressor described in PTL 1. FIG. 14 is a top plan view of a crankshaft of the conventional hermetic compressor. FIG. 15 is a sectional view of the crankshaft of the conventional hermetic compressor.

In FIGS. 13, 14 and 15, lubricating oil 902 is stored at an inner bottom of hermetic container 901. Compressor body 903 is formed of electric motor element 906 that includes stator 904 and rotor 905 and compression element 907 disposed above electric motor element 906. Compressor body 903 is supported by suspension springs 908 and is accommodated in hermetic container 901.

Compression element 907 is formed of, for example, crankshaft 909, cylinder block 910, piston 911, and connecting rod 912.

Crankshaft 909 is formed of main shaft 913, flange 914, and eccentric shaft 915. Flange 914 is positioned at an upper end of main shaft 913 to connect main shaft 913 and eccentric shaft 915. Eccentric shaft 915 is formed eccentrically to main shaft 913 and extends upward from flange 914. Crankshaft 909 is equipped with oil supply mechanism 916 extending between a lower end and an upper end of crankshaft 909.

Oil supply mechanism 916 is formed of spiral groove 916*a* formed in cylindrical surface 913*a* of main shaft 913 and oil supply passage 917 configured for communication between an upper part of cylindrical surface 913*a* of main shaft 913 and cylindrical surface 915*a* of eccentric shaft 915.

Cylinder block 910 includes substantially cylindrical cylinder bore 918 and bearing 919 rotatably supporting main shaft 913.

Piston 911 is inserted in cylinder bore 918 so as to slidably reciprocate. Piston 911 defines compression chamber 921 in combination with valve plate 920 disposed at an end of cylinder bore 918. Piston 911 is connected to eccentric shaft 915 by connecting rod 912.

Operation and workings of the conventional hermetic compressor thus configured are described hereinafter.

As electric motor element 906 is energized, a magnetic field is generated to stator 904, thereby causing rotor 905 to rotate together with crankshaft 909. In association with rotation of main shaft 913, eccentric shaft 915 rotates eccentrically. This eccentric rotation is converted via connecting rod 912 to reciprocating motion of piston 911 in cylinder bore 918. In this way, refrigerant gas inside hermetic container 901 is sucked into compression chamber 921 for compression.

The lower end of crankshaft 909 is immersed in lubricating oil 902. Through the rotation of crankshaft 909, lubricating oil 902 passes along spiral groove 916*a* to be supplied to the upper part of main shaft 913 and is then supplied to eccentric shaft 915 through oil supply passage 917 for lubrication of a sliding part.

For the purpose of reducing its shaft diameters and increasing an amount of eccentricity, crankshaft 909 of the hermetic compressor has, as shown in FIG. 14, oil supply passage 917 configured for the communication between cylindrical surface 915*a* of eccentric shaft 915 and the upper part of cylindrical surface 913*a* of main shaft 913. Center line X of oil supply passage 917 is included in plane B that does not intersect axis Y of main shaft 913, but is rotated through angle $\alpha$ relative to plane P defined by axis Y of main shaft 913 and axis Z of eccentric shaft 915. In this way, reduction in oil supply capacity is minimized, and suitable wall thicknesses are ensured.

However, in the structure of the conventional hermetic compressor, reducing respective diameters of main shaft 913 and eccentric shaft 915 of crankshaft 909 for reduction of mechanical losses of bearing 919 and connecting rod 912 results in the sum of respective radii of main shaft 913 and eccentric shaft 915 being smaller than the amount of eccentricity, that is, no overlap between main shaft 913 and eccentric shaft 915. In this case, angle $\alpha$ becomes small, and openings of oil supply passage 917 at main shaft 913 and eccentric shaft 915 are disposed in a region of a load of bearing 919 and a region of a load of connecting rod 912, respectively. Consequently, bearing strength reduces.

Moreover, shaft wall thicknesses esp1 and esp2 of FIG. 15 reduce, thereby reducing mechanical strength of crankshaft 909. Increase in thickness of flange 914 can lead to improvement of the shaft wall thicknesses but problematically causes increase in total length of crankshaft 909 and increase in total height of the hermetic compressor.

CITATION LIST

Patent Literature

PTL 1: Japanese Translation of PCT Publication No. 2013-545025

SUMMARY OF THE INVENTION

The present invention solves the above conventional problems and aims to provide a highly efficient and reliable hermetic compressor.

A hermetic compressor of the present invention accommodates in a hermetic container an electric motor element and a compression element driven by the electric motor element. The compression element includes a crankshaft including a main shaft, an eccentric shaft, and a flange, a cylinder block having a cylinder bore passing through the cylinder block in a cylindrical shape, and a piston configured to reciprocate in the cylinder bore. The compression element also includes a connecting rod connecting the piston and the eccentric shaft and a bearing formed on the cylinder block for pivotally supporting a radial load that acts on the main shaft of the crankshaft. The crankshaft further includes a communicating oil supply passage provided in the flange, a main shaft oil supply passage configured for communication between the communicating oil supply passage and a cylindrical surface of the main shaft, and an eccentric shaft oil supply passage configured for communication between the communicating oil supply passage and a cylindrical surface of the eccentric shaft.

Because of being independent passages, the main shaft oil supply passage and the eccentric shaft oil supply passage can be formed irrespective of shaft diameters and an amount of eccentricity of the crankshaft. This means that respective openings of the main shaft oil supply passage and the eccentric shaft oil supply passage can each be disposed other than a region of a bearing load. Consequently, bearing strength can be ensured.

The flange may have such a thickness as to form the communicating oil supply passage, and shaft wall thicknesses too can be ensured irrespective of the thickness of the flange. Accordingly, mechanical strength can be ensured for the crankshaft without increase in total height of the hermetic compressor.

The hermetic compressor of the present invention ensures the bearing strength and also ensures the mechanical strength of the crankshaft. With the shaft diameters of the crankshaft reduced, the hermetic compressor can have improved efficiency and increased reliability.

DESCRIPTION OF EMBODIMENTS

Exemplary embodiments of the present invention are described hereinafter with reference to the accompanying drawings. It is to be noted that these exemplary embodiments are not restrictive of the present invention.

First Exemplary Embodiment

Figure 1:
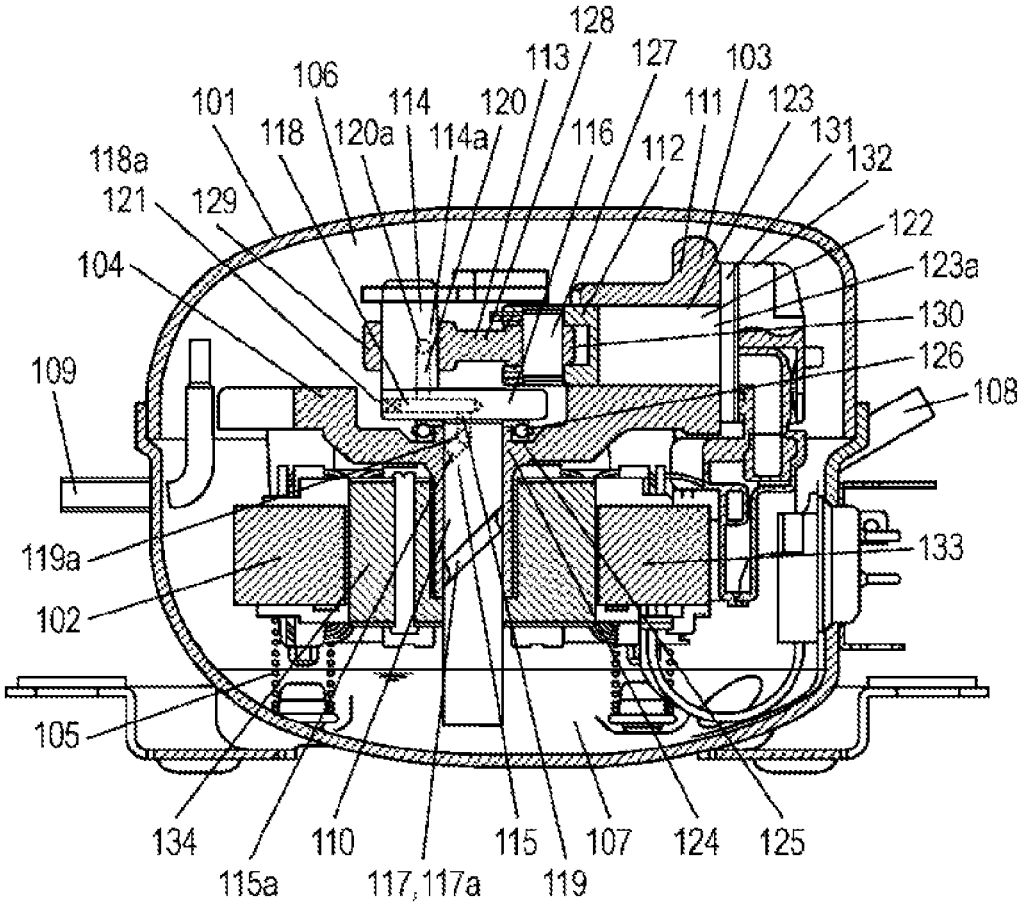
FIG. 1 is a longitudinal sectional view of a hermetic compressor according to a first exemplary embodiment of the present invention.

FIG. 1 is a longitudinal sectional view of a hermetic compressor according to the first exemplary embodiment of the present invention.

Figure 2:
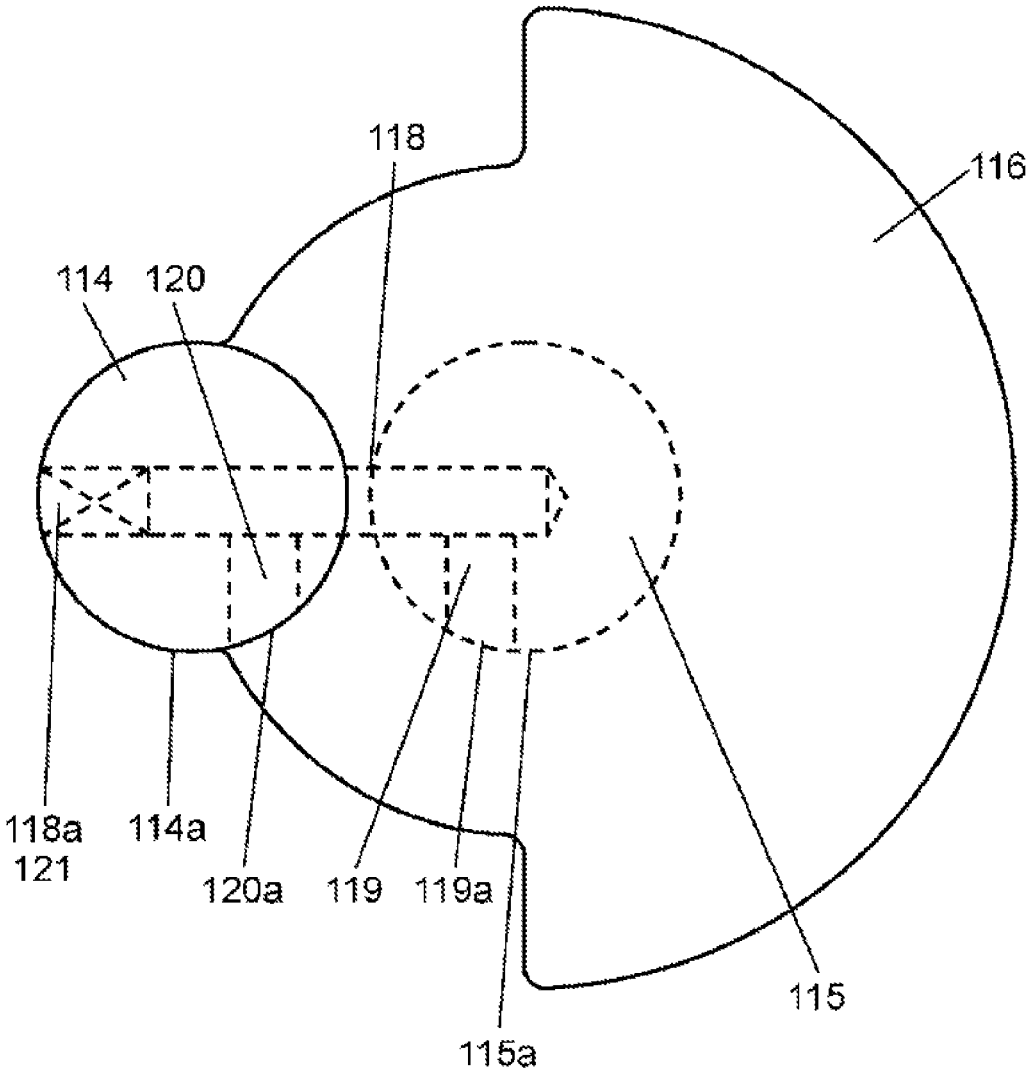
FIG. 2 is a top plan view of a crankshaft of the hermetic compressor according to the first exemplary embodiment of the present invention.
Figure 3:
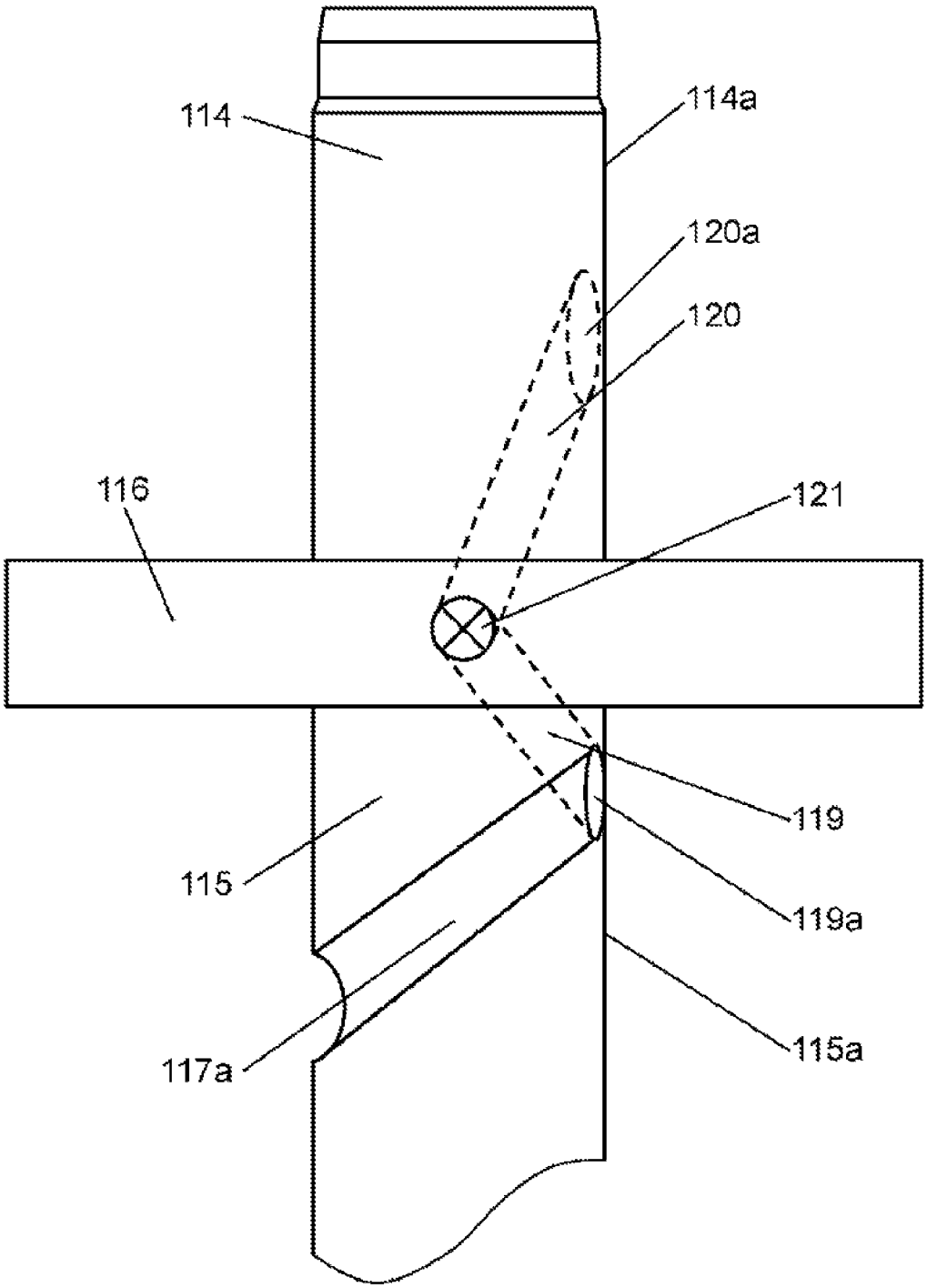
FIG. 3 is a side view of the crankshaft of the hermetic compressor according to the first exemplary embodiment of the present invention.

FIG. 2 is a top plan view of crankshaft 110 of the hermetic compressor. FIG. 3 is a side view of crankshaft 110 of the hermetic compressor.

In FIGS. 1, 2, and 3, the hermetic compressor according to the present exemplary embodiment has compressor body 104 disposed inside hermetic container 101 that is formed by draw-forming of an iron plate. Compressor body 104 mainly includes electric motor element 102 and compression element 103 driven by electric motor element 102. Compressor body 104 is elastically supported by suspension springs 105.

Hermetic container 101 is filled with, for example, hydrocarbon-based refrigerant gas 106 having a low global warming potential, such as R600a at a relatively low temperature and at a pressure equal to a pressure of a low-pressure side of a refrigeration device (not illustrated). Lubricating oil 107 is contained at an inner bottom of hermetic container 101 for lubrication.

Hermetic container 101 includes suction pipe 108 that has one end communicating with an internal space of hermetic container 101 and another end connected to the refrigeration device (not illustrated) and discharge pipe 109 that guides refrigerant gas 106 compressed by compression element 103 to the refrigeration device (not illustrated).

Compression element 103 is formed of, for example, crankshaft 110, cylinder block 111, piston 112, and connecting rod 113.

Crankshaft 110 includes eccentric shaft 114, main shaft 115, and flange 116 connecting eccentric shaft 114 and main shaft 115. Crankshaft 110 also includes oil supply mechanism 117 providing communication between a lower end of main shaft 115 that is immersed in lubricating oil 107 and an upper end of eccentric shaft 114.

Oil supply mechanism 117 of crankshaft 110 is formed of, for example, communicating oil supply passage 118, main shaft oil supply passage 119, eccentric shaft oil supply passage 120, and spiral groove 117*a*. Communicating oil supply passage 118 is provided to extend from an eccentric direction of flange 116 toward an axis center of main shaft 115. Main shaft oil supply passage 119 provides communication between cylindrical surface 115*a* of main shaft 115 and communicating oil supply passage 118. Eccentric shaft oil supply passage 120 provides communication between cylindrical surface 114*a* of eccentric shaft 114 and communicating oil supply passage 118. Spiral groove 117*a* is provided in cylindrical surface 115*a* of main shaft 115.

Main shaft oil supply passage 119 has opening 119*a* on cylindrical surface 115*a*, and this opening 119*a* is disposed other than a region of a bearing load. Eccentric shaft oil supply passage 120 has opening 120*a* on cylindrical surface 114*a*, and this opening 120*a* is disposed other than a region of a bearing load. Communicating oil supply passage 118 has opening 118*a* in the eccentric direction, and this opening 118*a* is closed with plug 121.

Cylinder block 111 is integrally formed with cylinder bore 123 defining compression chamber 122. Cylinder block 111 includes bearing 124 rotatably supporting main shaft 115, and thrust ball bearing 126 provided above thrust surface 125 for supporting a vertical load of crankshaft 110.

Piston 112 reciprocates in cylinder bore 123. Piston 112 is provided with piston pin 127 that has its axis parallel to an axis of eccentric shaft 114.

Connecting rod 113 has rod part 128, big end hole 129, and small end hole 130. Big end hole 129 fits in eccentric shaft 114 by insertion, while small end hole 130 fits in piston pin 127 by insertion. In this way, eccentric shaft 114 and piston 112 are connected.

Positioned opposite to crankshaft 110, opening end 123*a* of cylinder bore 123 has valve plate 131, a suction valve (not illustrated), and cylinder head 132 that are fixedly fastened together by a head bolt (not illustrated). Valve plate 131 has a suction hole (not illustrated) and a discharge hole (not illustrated). The suction valve (not illustrated) opens and closes the suction hole (not illustrated). Cylinder head 132 covers valve plate 131.

Cylinder head 132 has a discharge space into which refrigerant gas 106 is discharged. Direct communication is provided between the discharge space and discharge pipe 109 via a discharge tube (not illustrated).

Electric motor element 102 is formed of stator 133 and rotor 134. Stator 133 is fixed to a lower side of cylinder block 111 by a bolt (not illustrated). Rotor 134 is disposed inside stator 133 to be coaxial with stator 133 and is fixed to main shaft 115 by shrink fitting.

A description is provided hereinafter of operation and workings of the hermetic compressor thus constructed.

The hermetic compressor has its suction pipe 108 and discharge pipe 109 connected to the refrigeration device (not illustrated) having a well-known structure, thus being a part of a refrigerating cycle.

In the hermetic compressor having the above structure, as electric motor element 102 is energized, an electric current flows through stator 133, thereby producing a magnetic field, and rotor 134 fixed to main shaft 115 rotates accordingly. Through the rotation of rotor 134, crankshaft 110 rotates, whereby piston 112 reciprocates in cylinder bore 123 via connecting rod 113 attached rotatably to eccentric shaft 114.

The reciprocating motion of piston 112 causes refrigerant gas 106 to be sucked into compression chamber 122, compressed and discharged.

In association with the rotation of crankshaft 110, lubricating oil 107 passes along, for example, spiral groove 117*a* and reaches opening 119*a* of main shaft oil supply passage 119 by a result of effects by centrifugal force and a viscosity pump. Thereafter, lubricating oil 107 passes through main shaft oil supply passage 119, thus being guided to communicating oil supply passage 118. Next, lubricating oil 107 inside communicating oil supply passage 118 is caused by the centrifugal force associated with the rotation of crankshaft 110 to flow in the eccentric direction, thereby reaching eccentric shaft oil supply passage 120 that is positioned in the eccentric direction as compared with main shaft oil supply passage 119. Thereafter, lubricating oil 107 passes through eccentric shaft oil supply passage 120, thus being supplied to cylindrical surface 114*a* of eccentric shaft 114.

In a conventional hermetic compressor, there is direct communication between cylindrical surface 115*a* of main shaft 115 and cylindrical surface 114*a* of eccentric shaft 114, so that in cases where respective shaft diameters of main shaft 115 and eccentric shaft 114 are reduced without an overlap between main shaft 115 and eccentric shaft 114, openings are each disposed in a region of a bearing load. In addition, to ensure shaft wall thicknesses, flange 116 becomes thick.

In the present exemplary embodiment, however, crankshaft 110 includes communicating oil supply passage 118 in flange 116. Crankshaft 110 also includes main shaft oil supply passage 119 providing the communication between communicating oil supply passage 118 and cylindrical surface 115*a* of main shaft 115 and eccentric shaft oil supply passage 120 providing the communication between communicating oil supply passage 118 and cylindrical surface 114*a* of eccentric shaft 114.

Because of being independent passages, main shaft oil supply passage 119 and eccentric shaft oil supply passage 120 can be disposed irrespective of shaft diameters and an amount of eccentricity of crankshaft 110. This means that opening 119*a* of main shaft oil supply passage 119 and opening 120*a* of eccentric shaft oil supply passage 120 can each be disposed other than the region of the bearing load.

Thus, the shaft diameters of crankshaft 110 can be reduced while bearing strength is ensured. Consequently, improved efficiency can be obtained with reliability ensured.

Moreover, flange 116 may have such a thickness as to form communicating oil supply passage 118, and shaft wall thicknesses too can be ensured irrespective of the thickness of flange 116. Accordingly, mechanical strength can be ensured for crankshaft 110 without increase in total length of crankshaft 110. The hermetic compressor can thus ensure its reliability along with the improved efficiency without being increased in total height.

Furthermore, opening 118*a* of communicating oil supply passage 118 that is positioned in the eccentric direction is closed with plug 121.

In this way, the centrifugal force is maximized when acting on the lubricating oil inside communicating oil supply passage 118. Thus, capacity for oil supply to the eccentric shaft improves, thereby enabling further improvement of the reliability of the hermetic compressor.

Furthermore, the amount of eccentricity can be increased, so that even with a cylinder capacity being the same, cylinder bore 123 can have its diameter reduced. Accordingly, the hermetic compressor can be reduced in total height.

In cases where the hermetic compressor of the present exemplary embodiment is driven by an inverter for low-speed rotation, the centrifugal force decreases as rotational speed of crankshaft 110 reduces. However, the centrifugal force can be prevented from decreasing by increasing the amount of eccentricity for an increased radius of rotation of communicating oil supply passage 118, whereby capacity for oil supply to the eccentric shaft can be ensured.

As described above, the hermetic compressor of the present exemplary embodiment accommodates in hermetic container 101 electric motor element 102 and compression element 103 driven by electric motor element 102. Compression element 103 includes crankshaft 110 including main shaft 115, eccentric shaft 114, and flange 116, cylinder block 111 having cylinder bore 123 passing through cylinder block 111 in a cylindrical shape, and piston 112 configured to reciprocate in cylinder bore 123. Compression element 103 also includes connecting rod 113 connecting piston 112 and eccentric shaft 114 and bearing 124 formed on cylinder block 111 for pivotally supporting a radial load that acts on main shaft 115 of crankshaft 110. Crankshaft 110 further includes communicating oil supply passage 118 provided in flange 116, main shaft oil supply passage 119 configured for the communication between communicating oil supply passage 118 and cylindrical surface 115*a* of main shaft 115, and eccentric shaft oil supply passage 120 configured for the communication between communicating oil supply passage 118 and cylindrical surface 114*a* of eccentric shaft 114.

Because of being independent of each other, main shaft oil supply passage 119 and eccentric shaft oil supply passage 120 can be formed irrespective of the shaft diameters and the amount of eccentricity of crankshaft 110. The thickness of flange 116 may be such as to form communicating oil supply passage 118, and shaft wall thicknesses too can be ensured irrespective of the thickness of flange 116. Accordingly, mechanical strength can be ensured for crankshaft 110 without increase in total height of the hermetic compressor. For this reason, with its mechanical strength ensured, crankshaft 110 can have its shaft diameters reduced, whereby mechanical losses can be reduced. Consequently, the hermetic compressor can have both improved efficiency and reliability.

Moreover, communicating oil supply passage 118 may have opening 118*a* in the eccentric direction of flange 116, and this opening 118*a* may be closed with plug 121. In this way, the centrifugal force can be maximized when acting on lubricating oil 107 inside communicating oil supply passage 118. Thus, capacity for oil supply to eccentric shaft 114 improves, thereby the reliability of the hermetic compressor can be further improved.

Opening 119*a* of main shaft oil supply passage 119 and opening 120*a* of eccentric shaft oil supply passage 120 may be provided on the respective cylindrical surfaces to each be other than the region of the bearing load. In this way, bearing strength can be ensured. Consequently, the reliability of the hermetic compressor can improve further.

Furthermore, the hermetic compressor of the present exemplary embodiment may be driven by an inverter at a plurality of operating frequencies. Even in cases where the centrifugal force decreases because of low-speed rotation, the amount of eccentricity can be increased for an increased radius of rotation of communicating oil supply passage 118, so that capacity for oil supply to eccentric shaft 114 can be ensured.

Second Exemplary Embodiment

Figure 4:
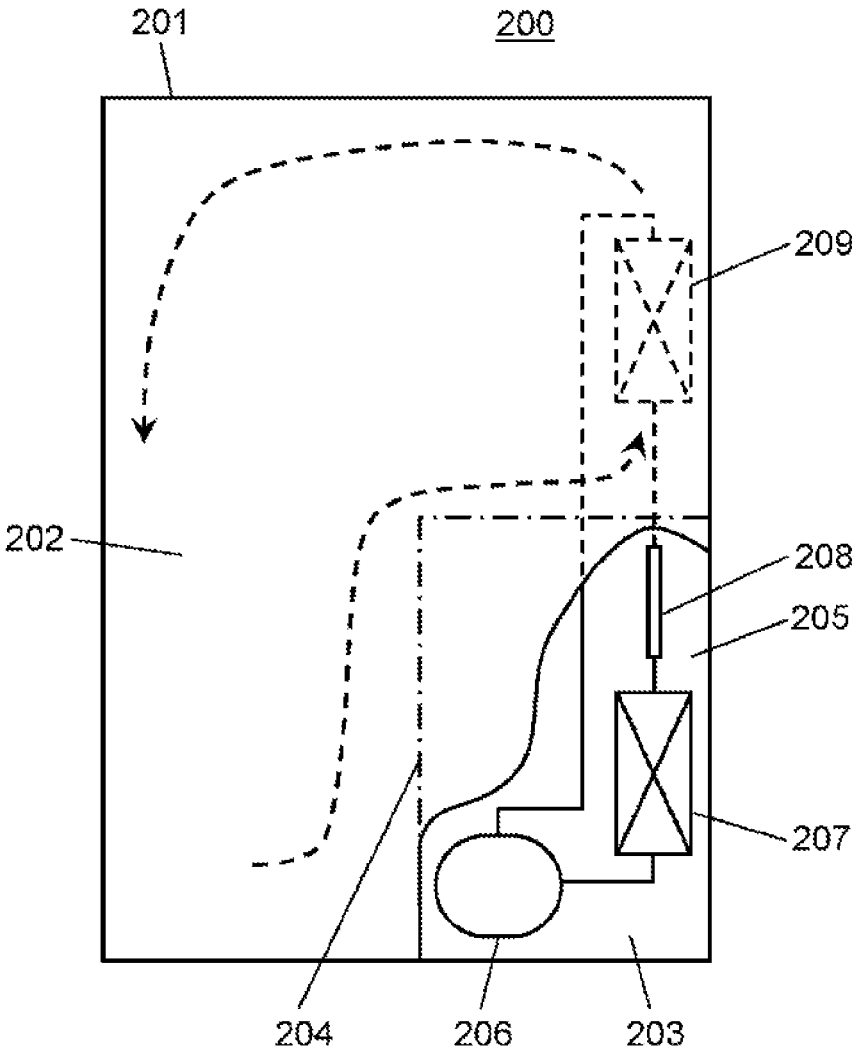
FIG. 4 is a schematic view illustrating a structure of a refrigeration device according to a second exemplary embodiment of the present invention.

FIG. 4 is a schematic view illustrating a structure of refrigeration device 200 according to the second exemplary embodiment of the present invention. Refrigeration device 200 is constructed to have hermetic compressor 206 in its refrigerant circuit 205. Hermetic compressor 206 mentioned here is the hermetic compressor described in the first exemplary embodiment. A summary of a basic structure of refrigeration device 200 is provided.

In FIG. 4, refrigeration device 200 includes main body 201, partition wall 204, and refrigerant circuit 205. Main body 201 includes a thermally insulated housing having an opening in one side, and an openable door that closes the opening. Partition wall 204 divides an interior of main body 201 into storage space 202 for articles and machine chamber 203. Refrigerant circuit 205 cools inside of storage space 202.

Refrigerant circuit 205 has hermetic compressor 206, radiator 207, decompression device 208, and heat absorber 209 that are connected in a loop by piping.

Heat absorber 209 is disposed in storage space 202 equipped with a blower (not illustrated). Cooling heat of heat absorber 209 is agitated by the blower to circulate inside storage space 202 as indicated by dashed arrows.

Hermetic compressor 206 is mounted in refrigeration device 200 described above. This hermetic compressor enables operation of the refrigerant circuit with improved reliability and efficiency because its mechanical loss reducing effect is obtained by reduction of shaft diameters of its crankshaft while bearing strength and mechanical strength of the crankshaft are ensured. Consequently, the refrigeration device has improved reliability and enables reduction in power consumption, thus realizing energy saving.

Since the hermetic compressor in the present exemplary embodiment can be reduced in height, a space for mounting the hermetic compressor can be reduced accordingly. Consequently, the refrigeration device can have a larger storage capacity.

As described above, refrigeration device 200 of the present exemplary embodiment includes refrigerant circuit 205 having hermetic compressor 206, radiator 207, decompression device 208, and heat absorber 209 that are connected in the loop by piping, and hermetic compressor 206 is the hermetic compressor of the first exemplary embodiment. By being mounted with hermetic compressor 206 having the improved efficiency, refrigeration device 200 can have its power consumption reduced, thus realizing the energy saving. Hermetic compressor 206 also has the improved reliability. Accordingly, refrigeration device 200 can have its reliability improved. The storage capacity of refrigeration device 200 can be increased by mounting hermetic compressor 206 that is reduced in total height.

Third Exemplary Embodiment

Figure 5:
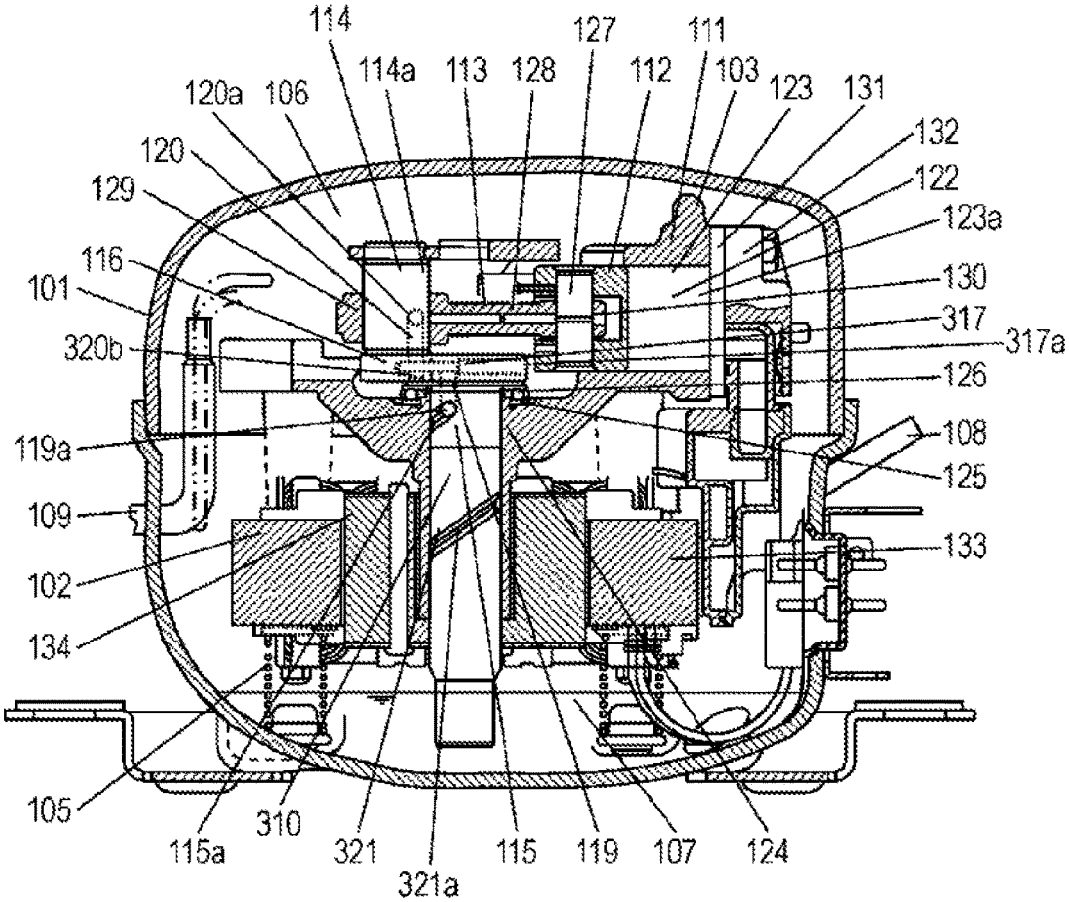
FIG. 5 is a longitudinal sectional view of a hermetic compressor according to a third exemplary embodiment of the present invention.
Figure 6:
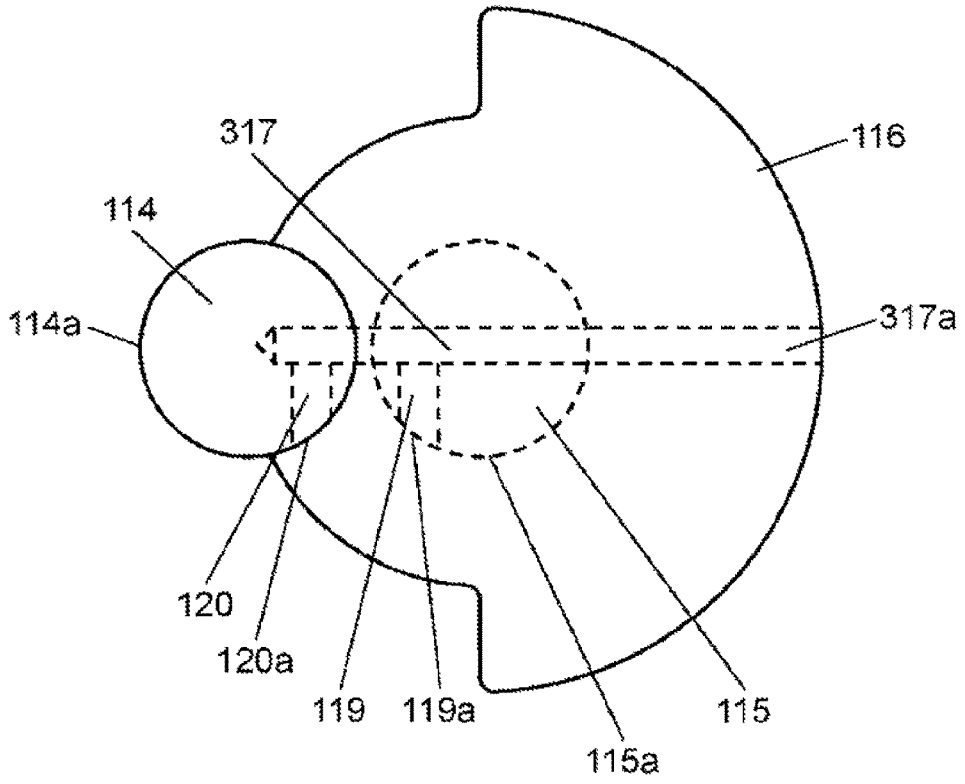
FIG. 6 is a top plan view of a crankshaft of the hermetic compressor according to the third exemplary embodiment of the present invention.
Figure 7:
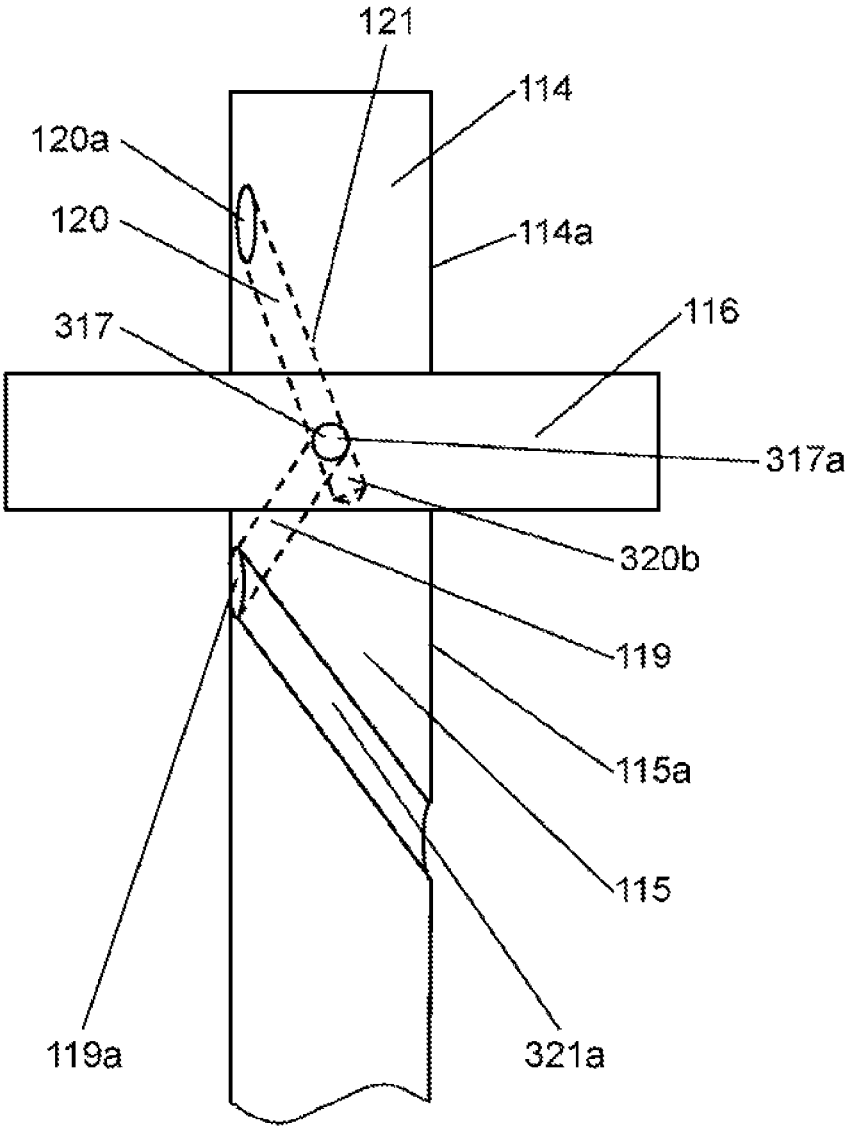
FIG. 7 is a side view of the crankshaft seen from a direction opposite to an eccentric shaft in the hermetic compressor according to the third exemplary embodiment of the present invention.

FIG. 5 is a longitudinal sectional view of a hermetic compressor according to the third exemplary embodiment of the present invention. FIG. 6 is a top plan view of crankshaft 310 of the hermetic compressor. FIG. 7 is a side view of crankshaft 310 seen from a direction opposite to an eccentric shaft of the hermetic compressor.

In the third exemplary embodiment, components similar to the components explained in the first exemplary embodiment have the same reference marks, and descriptions of those components are omitted.

Crankshaft 310 includes eccentric shaft 114, main shaft 115, and flange 116 connecting eccentric shaft 114 and main shaft 115. Crankshaft 310 also includes oil supply mechanism 321 providing communication between a lower end of main shaft 115 that is immersed in lubricating oil 107 and an upper end of eccentric shaft 114.

Oil supply mechanism 321 of crankshaft 310 is formed of, for example, communicating oil supply passage 317, main shaft oil supply passage 119, eccentric shaft oil supply passage 120, and spiral groove 321*a*. Communicating oil supply passage 317 is provided to extend from a side of flange 116 that is opposite to eccentric shaft 114 toward an axis of eccentric shaft 114. Main shaft oil supply passage 119 provides communication between cylindrical surface 115*a* of main shaft 115 and communicating oil supply passage 317. Eccentric shaft oil supply passage 120 provides communication between cylindrical surface 114*a* of eccentric shaft 114 and communicating oil supply passage 317. Spiral groove 321*a* is provided in cylindrical surface 115*a* of main shaft 115.

A description is provided hereinafter of operation and workings of the hermetic compressor thus constructed. The similar operation and workings of the first exemplary embodiment that appear in the present exemplary embodiment are omitted.

In association with rotation of crankshaft 310, lubricating oil 107 passes along spiral groove 321*a* and reaches opening 119*a* of main shaft oil supply passage 119 by a result of effects by centrifugal force and a viscosity pump. Thereafter, lubricating oil 107 passes through main shaft oil supply passage 119, thus being guided to communicating oil supply passage 317. Next, lubricating oil 107 inside communicating oil supply passage 317 is caused by the centrifugal force associated with the rotation of crankshaft 310 to flow in an eccentric direction, thereby reaching eccentric shaft oil supply passage 120 that is positioned in the eccentric direction as compared with main shaft oil supply passage 119. Thereafter, lubricating oil 107 passes through eccentric shaft oil supply passage 120, thus being supplied to cylindrical surface 114*a* of eccentric shaft 114.

In the present exemplary embodiment, crankshaft 310 includes communicating oil supply passage 317 in flange 116. Crankshaft 310 also includes main shaft oil supply passage 119 providing the communication between communicating oil supply passage 317 and cylindrical surface 115*a* of main shaft 115 and eccentric shaft oil supply passage 120 providing the communication between communicating oil supply passage 317 and cylindrical surface 114*a* of eccentric shaft 114.

Because of being independent passages, main shaft oil supply passage 119 and eccentric shaft oil supply passage 120 can be disposed irrespective of shaft diameters and an amount of eccentricity of crankshaft 310. This means that opening 119*a* of main shaft oil supply passage 119 and opening 120*a* of eccentric shaft oil supply passage 120 can each be disposed other than a region of a bearing load.

Thus, the shaft diameters of crankshaft 310 can be reduced while bearing strength is ensured. Consequently, improved efficiency can be obtained with reliability ensured.

Flange 116 may have such a thickness as to form communicating oil supply passage 317, and shaft wall thicknesses too can be ensured irrespective of the thickness of flange 116. Accordingly, mechanical strength can be ensured for crankshaft 310 without increase in total length of crankshaft 310. The hermetic compressor can thus ensure its reliability along with the improved efficiency without being increased in total height.

Opening 317*a* of communicating oil supply passage 317 opens in the direction opposite to eccentric shaft 114.

Thus, lubricating oil 107 is not caused to flow out from opening 317*a*, so that a plug for closing opening 317*a* is dispensable. Accordingly, the number of components can be reduced.

Communicating oil supply passage 317 is formed so that its side connecting with eccentric shaft oil supply passage 120 is positioned at a lower level than opening 317*a*.

During halts, lubricating oil 107 is thus accumulated on the side of communicating oil supply passage 317 that connects with eccentric shaft oil supply passage 120. The accumulated lubricating oil 107 can be used immediately for lubricating eccentric shaft 114 at a restart.

Base 320*b* of eccentric shaft oil supply passage 120 is positioned at a lower level than communicating oil supply passage 317.

Thus, the lubricating oil is accumulated on base 320*b* during halts. The accumulated lubricating oil 107 can be used immediately for lubricating eccentric shaft 114 at a restart.

In cases where the hermetic compressor of the present exemplary embodiment is driven by an inverter for low-speed rotation, the centrifugal force decreases as rotational speed of crankshaft 310 reduces. However, the centrifugal force can be prevented from decreasing by increasing the amount of eccentricity for an increased radius of rotation of communicating oil supply passage 317, whereby capacity for oil supply to the eccentric shaft can be ensured.

As described above, communicating oil supply passage 317 opens in the direction opposite to eccentric shaft 114 in the hermetic compressor of the present exemplary embodiment. Because of being formed from the side opposite to eccentric shaft 114, communicating oil supply passage 317 does not need to be plugged, for example. Accordingly, the number of components can be reduced for cost reduction.

Moreover, the opening of main shaft oil supply passage 119 and opening 120*a* of eccentric shaft oil supply passage 120 may be provided on the respective cylindrical surfaces to each be other than the region of the bearing load. In this way, bearing strength can be ensured. Consequently, the hermetic compressor can have improved reliability.

Furthermore, communicating oil supply passage 317 may be such that its side connecting with eccentric shaft oil supply passage 120 is positioned at a lower level than a position where it opens in flange 116. Lubricating oil 107 is thus accumulated on the side of communicating oil supply passage 317 that connects with eccentric shaft oil supply passage 120 during halts and can be used immediately for lubricating eccentric shaft 114 at a restart. Consequently, the reliability of the hermetic compressor can be further improved.

Furthermore, base 320*b* of eccentric shaft oil supply passage 120 may be positioned at a lower level than communicating oil supply passage 317. Lubricating oil 107 is thus accumulated on base 320*b* of eccentric shaft oil supply passage 120 during halts and can be used immediately for lubricating eccentric shaft 114 at a restart. Consequently, the reliability of the hermetic compressor can be further improved.

Furthermore, the hermetic compressor of the present exemplary embodiment may be driven by an inverter at a plurality of operating frequencies. Even in cases where the centrifugal force decreases because of low-speed rotation, the amount of eccentricity can be increased for an increased radius of rotation of communicating oil supply passage 317, so that capacity for oil supply to eccentric shaft 114 can be ensured.

Fourth Exemplary Embodiment

Figure 8:
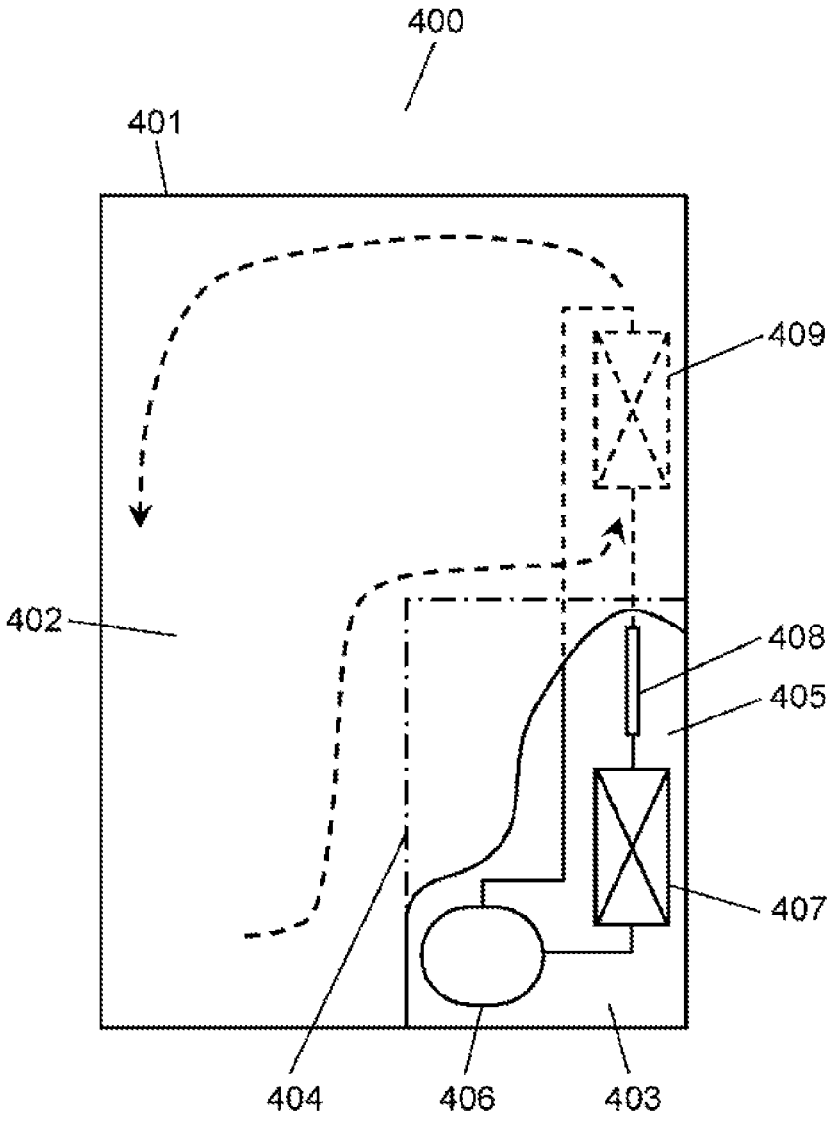
FIG. 8 is a schematic view illustrating a structure of a refrigeration device according to a fourth exemplary embodiment of the present invention.

FIG. 8 is a schematic view illustrating a structure of refrigeration device 400 according to the fourth exemplary embodiment of the present invention. Refrigeration device 400 is constructed to have hermetic compressor 406 in its refrigerant circuit 405. Hermetic compressor 406 mentioned here is the hermetic compressor described in the third exemplary embodiment. A summary of a basic structure of refrigeration device 400 is provided.

In FIG. 8, refrigeration device 400 includes main body 401, partition wall 404, and refrigerant circuit 405. Main body 401 includes a thermally insulated housing having an opening in one side, and an openable door that closes the opening. Partition wall 404 divides an interior of main body 401 into storage space 402 for articles and machine chamber 403. Refrigerant circuit 405 effects cools inside of storage space 402.

Refrigerant circuit 405 has hermetic compressor 406 described in the third exemplary embodiment, radiator 407, decompression device 408, and heat absorber 409 that are connected in a loop by piping.

Heat absorber 409 is disposed in storage space 402 equipped with a blower (not illustrated). Cooling heat of heat absorber 409 is agitated by the blower to circulate inside storage space 402 as indicated by dashed arrows.

Hermetic compressor 406 described in the third exemplary embodiment of the present invention is mounted in refrigeration device 400 described above. This hermetic compressor enables operation of the refrigerant circuit with improved reliability and efficiency because its mechanical loss reducing effect is obtained by reduction of shaft diameters of its crankshaft while bearing strength and mechanical strength of the crankshaft are ensured. Consequently, the refrigeration device has improved reliability and enables reduction in power consumption, thus realizing energy saving.

Since the hermetic compressor of the third exemplary embodiment can be reduced in height, a space for mounting the hermetic compressor can be reduced accordingly. Consequently, the refrigeration device can have a larger storage capacity.

Moreover, the compressor is highly reliable because of being provided with a lubricating oil sump about a middle of its oil supply mechanism, thus effecting improvement of the reliability of the refrigeration device.

As described above, refrigeration device 400 of the present exemplary embodiment includes refrigerant circuit 405 having hermetic compressor 406, radiator 407, decompression device 408, and heat absorber 409 that are connected in the loop by piping, and hermetic compressor 406 is the hermetic compressor of the third exemplary embodiment. By being mounted with hermetic compressor 406 having the improved efficiency, refrigeration device 400 can have its power consumption reduced, thus realizing the energy saving. Hermetic compressor 406 also has the improved reliability. Accordingly, refrigeration device 400 can have its reliability improved. The storage capacity of refrigeration device 400 can be increased by mounting hermetic compressor 406 that is reduced in total height.

Fifth Exemplary Embodiment

Figure 9:
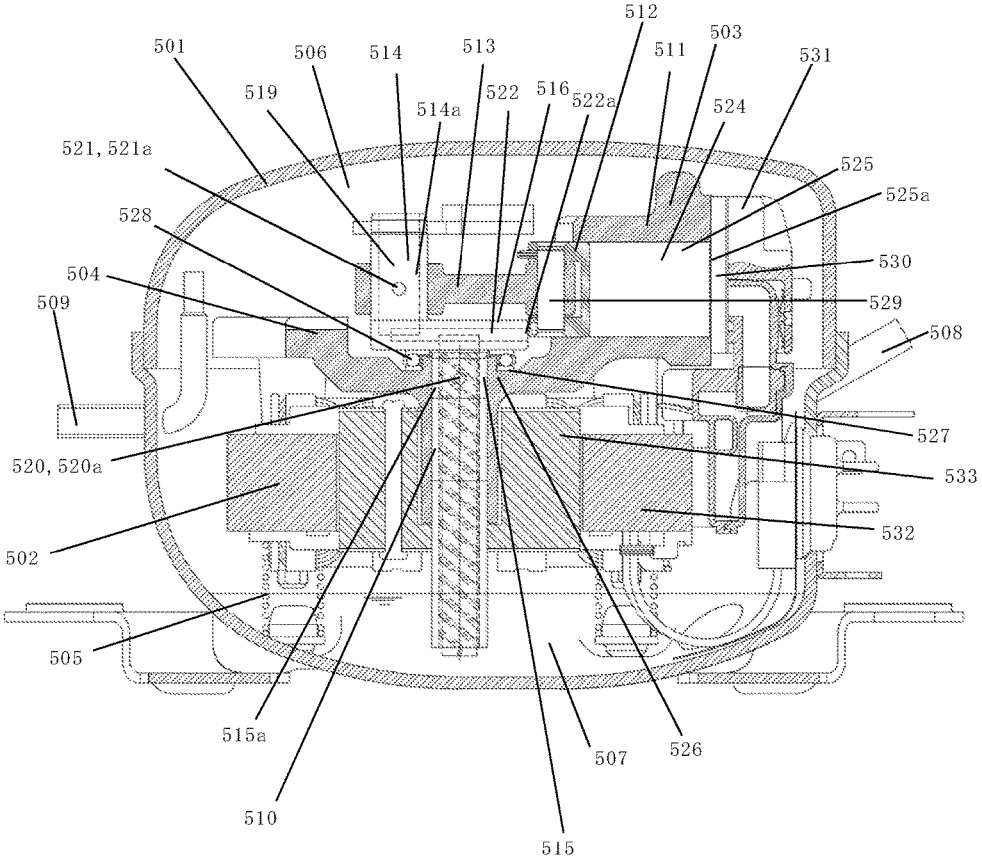
FIG. 9 is a longitudinal sectional view of a hermetic compressor according to a fifth exemplary embodiment of the present invention.
Figure 10:
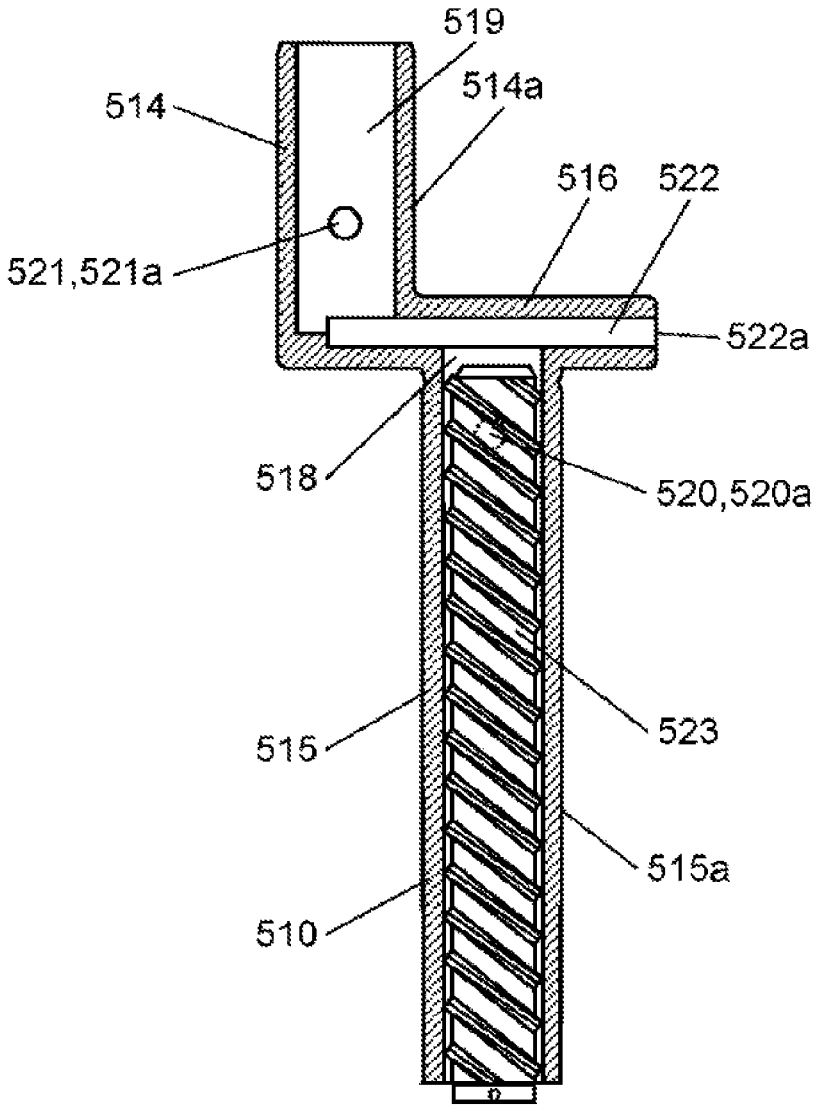
FIG. 10 is a longitudinal sectional view of a crankshaft of the hermetic compressor according to the fifth exemplary embodiment of the present invention.

FIG. 9 is a longitudinal sectional view of a hermetic compressor according to the fifth exemplary embodiment of the present invention. FIG. 10 is a longitudinal sectional view of crankshaft 510 of the hermetic compressor.

In FIGS. 9 and 10, the hermetic compressor according to the present exemplary embodiment has compressor body 504 disposed inside hermetic container 501 that is formed by draw-forming of an iron plate. Compressor body 504 mainly includes electric motor element 502 and compression element 503 driven by electric motor element 502. Compressor body 504 is elastically supported by suspension springs 505.

Hermetic container 501 is filled with, for example, hydrocarbon-based refrigerant gas 506 having a low global warming potential, such as R600a at a relatively low temperature and at a pressure equal to a pressure of a low-pressure side of a refrigeration device (not illustrated). Lubricating oil 507 is contained at an inner bottom of hermetic container 501 for lubrication.

Hermetic container 501 includes suction pipe 508 that has one end communicating with an internal space of hermetic container 501 and another end connected to the refrigeration device (not illustrated) and discharge pipe 509 that guides refrigerant gas 506 compressed by compression element 503 to the refrigeration device (not illustrated).

Compression element 503 is formed of, for example, crankshaft 510, cylinder block 511, piston 512, and connecting rod 513.

Crankshaft 510 includes eccentric shaft 514, main shaft 515, and flange 516 connecting eccentric shaft 514 and main shaft 515. Crankshaft 510 also includes oil supply mechanism providing communication between a lower end of main shaft 515 that is immersed in lubricating oil 507 and an upper end of eccentric shaft 514.

Oil supply mechanism is formed of main shaft oil supply route 518, eccentric shaft oil supply route 519, main shaft oil supply passage 520, eccentric shaft oil supply passage 521, communicating oil supply passage 522, and a viscosity pump. Main shaft oil supply route 518 is disposed in a shaft center part of main shaft 515 and reaches flange 516. Eccentric shaft oil supply route 519 is disposed in a shaft center part of eccentric shaft 514 and reaches flange 516. Main shaft oil supply passage 520 provides communication between main shaft oil supply route 518 and cylindrical surface 515*a* of main shaft 515. Eccentric shaft oil supply passage 521 provides communication between eccentric shaft oil supply route 519 and cylindrical surface 514*a* of eccentric shaft 514. Communicating oil supply passage 522 in flange 516 opens on a side opposite to eccentric shaft 514 and communicates with main shaft oil supply route 518 and eccentric shaft oil supply route 519. The viscosity pump is formed inside main shaft oil supply route 518.

The viscosity pump is formed by disposing inside main shaft oil supply route 518 component 523 that is formed with a spiral groove in its outer circumferential surface.

Main shaft oil supply passage 520 has opening 520*a* on cylindrical surface 515*a*, and this opening 520*a* is disposed other than a region of a bearing load. Eccentric shaft oil supply passage 521 has opening 521*a* on cylindrical surface 514*a*, and this opening 521*a* is disposed other than a region of a bearing load.

Cylinder block 511 is integrally formed with cylinder bore 525 defining compression chamber 524. Cylinder block 511 includes bearing 526 rotatably supporting main shaft 515, and thrust ball bearing 528 provided above thrust surface 527 for supporting a vertical load of crankshaft 510.

Piston 512 reciprocates in cylinder bore 525. Piston 512 is provided with piston pin 529 that has its axis parallel to an axis of eccentric shaft 514.

Connecting rod 513 has rod part 540, big end hole 541, and small end hole 542. Big end hole 541 fits in eccentric shaft 514 by insertion, while small end hole 542 fits in piston pin 529 by insertion. In this way, eccentric shaft 514 and piston 512 are connected.

Positioned opposite to crankshaft 510, opening end 525*a* of cylinder bore 525 has valve plate 530, a suction valve (not illustrated), and cylinder head 531 that are fixedly fastened together by a head bolt (not illustrated). Valve plate 530 has a suction hole (not illustrated) and a discharge hole (not illustrated). The suction valve (not illustrated) opens and closes the suction hole (not illustrated). Cylinder head 531 covers valve plate 530.

Cylinder head 531 has a discharge space into which refrigerant gas 506 is discharged. Direct communication is provided between the discharge space and discharge pipe 509 via a discharge tube (not illustrated).

Electric motor element 502 is formed of stator 532 and rotor 533. Stator 532 is fixed to a lower side of cylinder block 511 by a bolt (not illustrated). Rotor 533 is disposed inside stator 532 to be coaxial with stator 532 and is fixed to main shaft 515 by shrink fitting.

A description is provided hereinafter of operation and workings of the hermetic compressor thus constructed.

The hermetic compressor has its suction pipe 508 and discharge pipe 509 connected to the refrigeration device (not illustrated), thus being a part of a refrigerating cycle.

In the hermetic compressor having the above structure, as electric motor element 502 is energized, an electric current flows through stator 532, thereby producing a magnetic field, and rotor 533 fixed to main shaft 515 rotates accordingly. Through the rotation of rotor 533, crankshaft 510 rotates, whereby piston 512 reciprocates in cylinder bore 525 via connecting rod 513 attached rotatably to eccentric shaft 514.

The reciprocating motion of piston 512 causes refrigerant gas 506 to be sucked into compression chamber 524, compressed and discharged.

In association with the rotation of crankshaft 510, lubricating oil 507 shows its viscosity effect, thus passing through main shaft oil supply route 518 and reaching flange 516. The spiral groove is formed in the outer circumferential surface of component 523 that is disposed inside main shaft oil supply route 518 so as not to rotate. The viscosity effect takes place between the spiral groove and an inner circumferential surface of main shaft oil supply route 518. Some of lubricating oil 507 passes through main shaft oil supply passage 520 provided about a middle of main shaft oil supply route 518, thus being supplied to main shaft 515. Lubricating oil 507 that reaches flange 516 is caused by centrifugal force to pass through communicating oil supply passage 522, and here, some of lubricating oil 507 is guided to eccentric shaft oil supply route 519, while remaining lubricating oil 507 is guided to opening 522*a* positioned opposite to eccentric shaft 514. Lubricating oil 507 guided to eccentric shaft oil supply route 519 passes through eccentric shaft oil supply passage 521, thus being supplied to eccentric shaft 514. Lubricating oil 507 guided to opening 522*a* positioned opposite to eccentric shaft 514 is sprinkled through the rotation of crankshaft 510, whereby some of lubricating oil 507 is supplied to a sliding part between piston 512 and cylinder bore 525.

The use of the viscosity pump here enables oil supply utilizing viscous friction even in cases where oil supply using centrifugal force is difficult because of a small inner diameter of main shaft oil supply route 518 and a high head between an oil level of lubricating oil 507 and flange 516.

In the present exemplary embodiment, component 523 formed with the spiral groove in its outer circumferential surface is disposed inside main shaft oil supply route 518. However, a similar effect can be obtained even in cases where main shaft oil supply route 518 is formed with a spiral groove in its inner circumferential surface while component 523 having a cylindrical outer circumferential surface is disposed inside main shaft oil supply route 518.

In a conventional hermetic compressor, there is direct communication between cylindrical surface 515*a* of main shaft 515 and cylindrical surface 514*a* of eccentric shaft 514, so that in cases where respective shaft diameters of main shaft 515 and eccentric shaft 514 are reduced without an overlap between main shaft 515 and eccentric shaft 514, openings are each disposed in a region of a bearing load. In addition, to ensure shaft wall thicknesses, flange 516 becomes thick.

In the present exemplary embodiment, however, main shaft 515 is provided with, in its shaft center part, main shaft oil supply route 518 that reaches flange 516, and eccentric shaft 514 is provided with, in its shaft center part, eccentric shaft oil supply route 519 that reaches flange 516. Main shaft oil supply passage 520 is provided for the communication between main shaft oil supply route 518 and cylindrical surface 515*a* of main shaft 515, and eccentric shaft oil supply passage 521 is provided for the communication between eccentric shaft oil supply route 519 and cylindrical surface 514*a* of eccentric shaft 514. Flange 516 is provided with communicating oil supply passage 522 that communicates with main shaft oil supply route 518 and eccentric shaft oil supply route 519. Because of being independent passages, main shaft oil supply passage 520 and eccentric shaft oil supply passage 521 can be disposed irrespective of shaft diameters and an amount of eccentricity of crankshaft 510. This means that opening 520*a* of main shaft oil supply passage 520 and opening 521*a* of eccentric shaft oil supply passage 521 can each be disposed other than the region of the bearing load.

Thus, the shaft diameters of crankshaft 510 can be reduced while bearing strength is ensured. Consequently, improved efficiency can be obtained with reliability ensured.

Moreover, flange 516 may have such a thickness as to form communicating oil supply passage 522, and shaft wall thicknesses too can be ensured irrespective of the thickness of flange 516. Accordingly, mechanical strength can be ensured for crankshaft 510 without increase in total length of crankshaft 510. The hermetic compressor can thus ensure its reliability along with the improved efficiency without being increased in total height.

Since eccentric shaft 514 and piston 512 are spaced apart, sprinkling from a top portion of eccentric shaft 514 causes an oil supply position of piston 512 to change according to rotational speed of crankshaft 510, so that stable oil supply is difficult.

On the other hand, the present exemplary embodiment has communicating oil supply passage 522 that has opening 522*a* formed opposite to eccentric shaft 514. For this reason, lubricating oil 507 can be supplied from below piston 512 to the sliding part between piston 512 and cylinder bore 525. Because opening 522*a* is close to piston 512, an oil supply position is fixed, thus enabling stable oil supply. Consequently, the reliability of the hermetic compressor can be further improved.

Furthermore, the amount of eccentricity can be increased, so that even with a cylinder capacity being the same, cylinder bore 525 can have its diameter reduced. Accordingly, the hermetic compressor can be reduced in total height.

In cases where the hermetic compressor of the present exemplary embodiment is driven by an inverter for low-speed rotation, the centrifugal force decreases as the rotational speed of crankshaft 510 reduces. However, the centrifugal force can be prevented from decreasing by increasing the amount of eccentricity for an increased radius of rotation of communicating oil supply passage 522, whereby oil supply capacity can be ensured.

As described above, the hermetic compressor of the present exemplary embodiment accommodates in hermetic container 501 electric motor element 502 and compression element 503 driven by electric motor element 502. Compression element 503 includes crankshaft 510 including main shaft 515, eccentric shaft 514, and flange 516, cylinder block 511 having cylinder bore 525 passing through cylinder block 511 in a cylindrical shape, and piston 512 configured to reciprocate in cylinder bore 525. Compression element 503 also includes connecting rod 513 connecting piston 512 and eccentric shaft 514 and bearing 526 formed on cylinder block 511 for pivotally supporting a radial load that acts on main shaft 515 of crankshaft 510. Crankshaft 510 further includes, in the shaft center part of main shaft 515, main shaft oil supply route 518 that reaches flange 516 and, in the shaft center part of eccentric shaft 514, eccentric shaft oil supply route 519 that reaches flange 516. Moreover, main shaft oil supply passage 520 provides the communication between main shaft oil supply route 518 and cylindrical surface 515*a* of main shaft 515, eccentric shaft oil supply passage 521 provides the communication between eccentric shaft oil supply route 519 and cylindrical surface 514*a* of eccentric shaft 514, and communicating oil supply passage 522 communicates with main shaft oil supply route 518 and eccentric shaft oil supply route 519.

Because of being independent, main shaft oil supply passage 520 and eccentric shaft oil supply passage 521 can be formed irrespective of the shaft diameters and the amount of eccentricity of crankshaft 510. The thickness of flange 516 may be such as to form communicating oil supply passage 522, and shaft wall thicknesses too can be ensured irrespective of the thickness of flange 516. Accordingly, mechanical strength can be ensured for crankshaft 510 without increase in total height of the hermetic compressor. For this reason, with its mechanical strength ensured, crankshaft 510 can have its shaft diameters reduced, whereby mechanical losses can be reduced. Consequently, the hermetic compressor can have both improved efficiency and reliability.

Moreover, opening 520*a* of main shaft oil supply passage 520 and opening 521*a* of eccentric shaft oil supply passage 521 may be provided on the respective cylindrical surfaces to each be other than the region of the bearing load. In this way, bearing strength can be ensured. Consequently, the reliability of the hermetic compressor can be further improved.

Furthermore, communicating oil supply passage 522 may have the opening positioned opposite to eccentric shaft 514, so that both its side connecting with eccentric shaft 514 and its side opposite to eccentric shaft 514 can be supplied with lubricating oil 507. With the side opposite to eccentric shaft 514 being supplied with lubricating oil 507, the sliding part between piston 512 and cylinder bore 525 can be supplied with lubricating oil 507. Consequently, the reliability of the hermetic compressor can be further improved.

Furthermore, main shaft oil supply route 518 may include the viscosity pump. This enables oil supply even in cases where oil supply using centrifugal force is difficult because of a small inner diameter of main shaft oil supply route 518 and a high head between the oil level and flange 516. Accordingly, the reliability can be improved.

Furthermore, the viscosity pump may be formed of the inner circumferential surface of main shaft oil supply route 518 and the spiral groove formed in the outer circumferential surface of component 523 that is provided inside main shaft oil supply route 518. In this way, the viscosity pump can be formed with ease.

Furthermore, the hermetic compressor of the present exemplary embodiment may be driven by an inverter at a plurality of operating frequencies. Even in cases where the centrifugal force decreases because of low-speed rotation, the amount of eccentricity can be increased for an increased radius of rotation of communicating oil supply passage 522, so that capacity for oil supply to eccentric shaft 514 can be ensured.

Sixth Exemplary Embodiment

Figure 11:
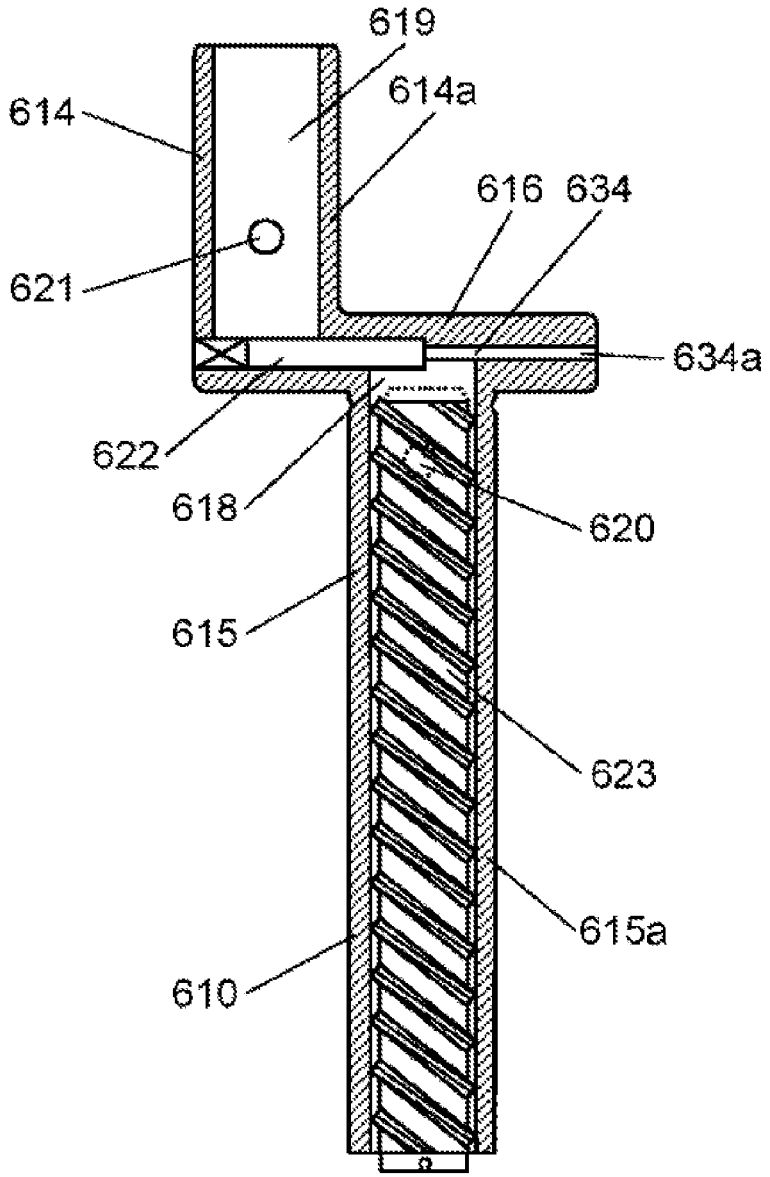
FIG. 11 is a longitudinal sectional view of a crankshaft of a hermetic compressor according to a sixth exemplary embodiment of the present invention.

FIG. 11 is a longitudinal sectional view of crankshaft 610 of a hermetic compressor according to the sixth exemplary embodiment of the present invention.

The hermetic compressor of the present exemplary embodiment has the same basic structure as the hermetic compressor of FIG. 9, so that a description of the basic structure is omitted.

Crankshaft 610 includes eccentric shaft 614, main shaft 615, and flange 616 connecting eccentric shaft 614 and main shaft 615. Crankshaft 610 also includes oil supply mechanism 617 providing communication between a lower end of main shaft 615 that is immersed in lubricating oil 507 (refer to FIG. 9) and an upper end of eccentric shaft 614.

Oil supply mechanism 617 is formed of main shaft oil supply route 618, eccentric shaft oil supply route 619, main shaft oil supply passage 620, eccentric shaft oil supply passage 621, communicating oil supply passage 622, non-eccentric shaft side oil supply passage 634, and a viscosity pump. Main shaft oil supply route 618 is disposed in a shaft center part of main shaft 615 and reaches flange 616. Eccentric shaft oil supply route 619 is disposed in a shaft center part of eccentric shaft 614 and reaches flange 616. Main shaft oil supply passage 620 provides communication between main shaft oil supply route 618 and cylindrical surface 615*a* of main shaft 615. Eccentric shaft oil supply passage 621 provides communication between eccentric shaft oil supply route 619 and cylindrical surface 614*a* of eccentric shaft 614. Communicating oil supply passage 622 in flange 616 opens on a side of eccentric shaft 614 and communicates with main shaft oil supply route 618 and eccentric shaft oil supply route 619. Non-eccentric shaft side oil supply passage 634 in flange 616 opens on a side opposite to eccentric shaft 614 and communicates with main shaft oil supply route 618. The viscosity pump is formed inside main shaft oil supply route 618. Communicating oil supply passage 622 and non-eccentric shaft side oil supply passage 634 have different sectional areas.

With the above structure, lubricating oil 507 (refer to FIG. 9) reaches flange 616 after passing through main shaft oil supply route 618, and here, some of lubricating oil 507 is guided through communicating oil supply passage 622 to eccentric shaft oil supply route 619, while remaining lubricating oil 507 is guided through non-eccentric shaft side oil supply passage 634 to opening 634*a* positioned on the side of flange 616 that is opposite to eccentric shaft 614.

Lubricating oil 507 (refer to FIG. 9) guided to eccentric shaft oil supply route 619 passes through eccentric shaft oil supply passage 621, thus being supplied to eccentric shaft 614. Lubricating oil 507 (refer to FIG. 9) guided to opening 634*a* positioned on the side of flange 616 that is opposite to eccentric shaft 614 is sprinkled through rotation of crankshaft 610, whereby some of lubricating oil 507 is supplied to a sliding part between piston 512 (refer to FIG. 9) and cylinder bore 525 (refer to FIG. 9).

Communicating oil supply passage 622 and non-eccentric shaft side oil supply passage 634 have the different sectional areas. For this reason, a ratio of an amount of oil supply to eccentric shaft 614 to an amount of oil supply to the sliding part between piston 512 (refer to FIG. 9) and cylinder bore 525 (refer to FIG. 9) can be optimized according to a specification such as an amount of eccentricity or a size of flange 616.

Moreover, closing opening 622*a* of communicating oil supply passage 622 with a plug or the like can ensure oil supply to eccentric shaft 614.

As described above, communicating oil supply passage 622 in the flange has opening 622*a* on the side connecting with eccentric shaft 614 and communicates with main shaft oil supply route 618 in the hermetic compressor of the present exemplary embodiment. Non-eccentric shaft side oil supply passage 634 has the opening on the side of the flange that is opposite to eccentric shaft 614. The sectional area of communicating oil supply passage 622 differs from the sectional area of non-eccentric shaft side oil supply passage 634. The ratio of the amount of oil supply to eccentric shaft 614 to the amount of oil supply to the sliding part between piston 512 and cylinder bore 525 can thus be changed, so that the amounts of oil supply can be optimized according to a specification such as the amount of eccentricity or the size of flange 616.

Seventh Exemplary Embodiment

Figure 12:
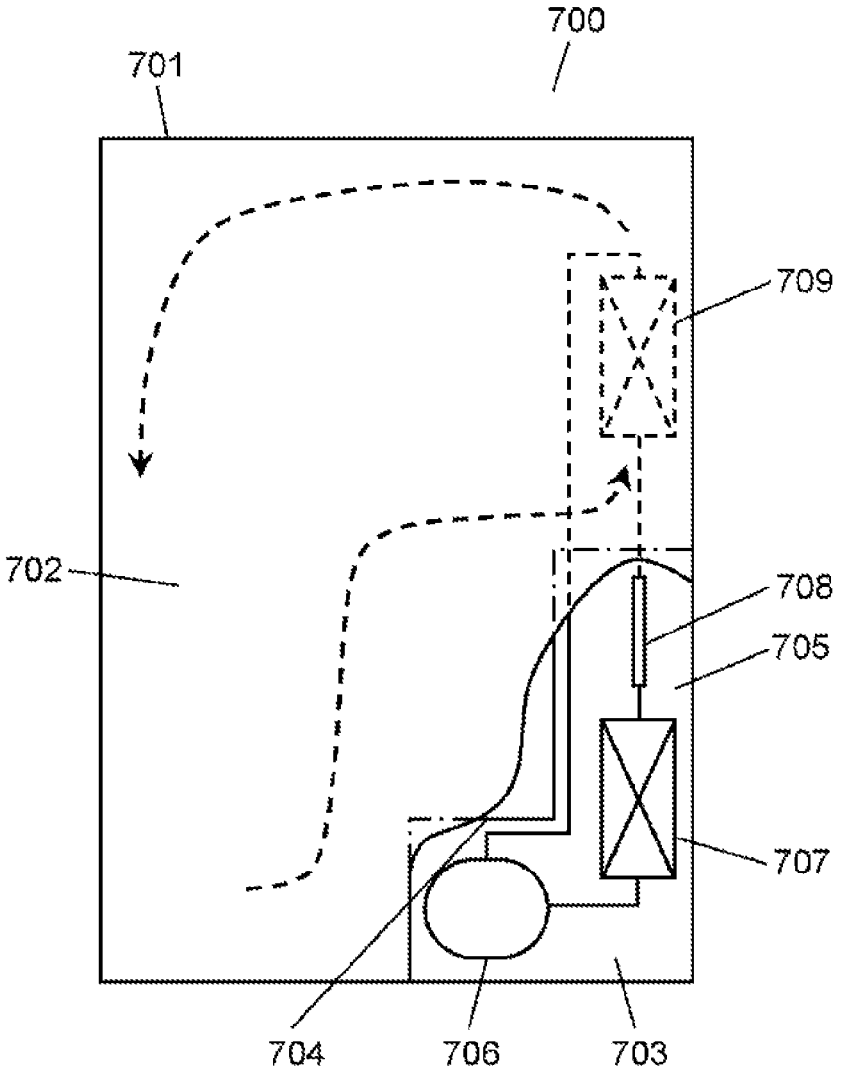
FIG. 12 is a schematic view illustrating a structure of a refrigeration device according to a seventh exemplary embodiment of the present invention.
Figure 13:
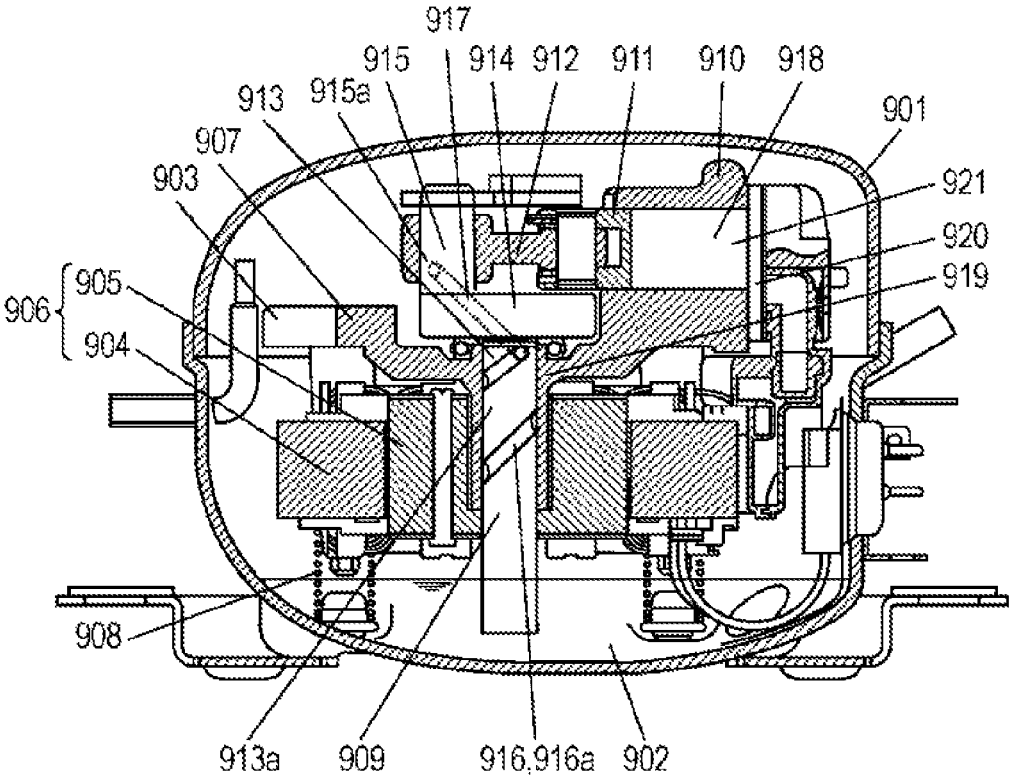
FIG. 13 is a longitudinal sectional view of a conventional hermetic compressor described in PTL 1.
Figure 14:
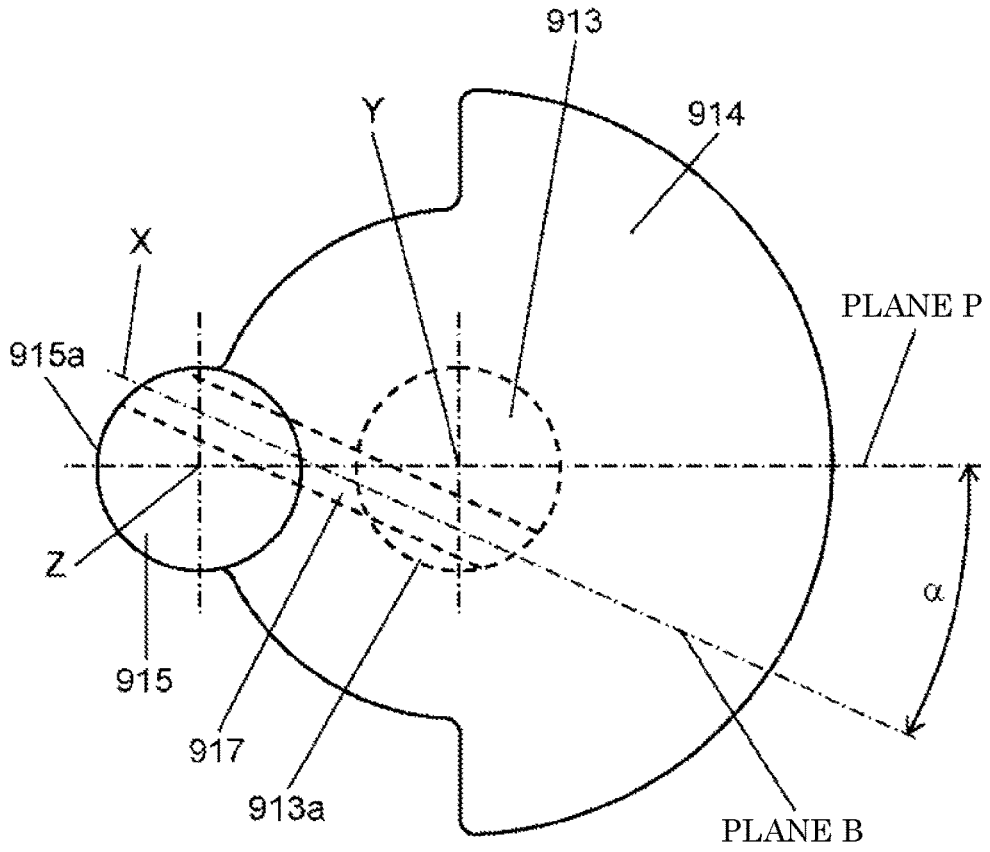
FIG. 14 is a top plan view of a crankshaft of the conventional hermetic compressor described in PTL 1.
Figure 15:
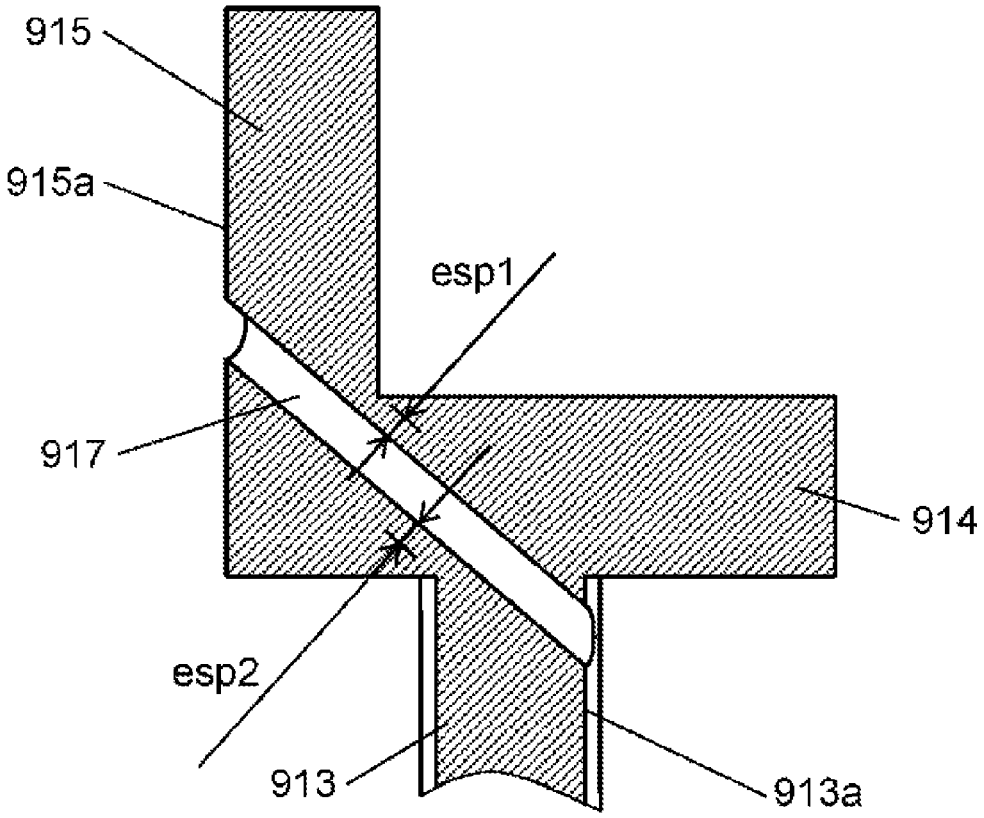
FIG. 15 is a longitudinal sectional view of the crankshaft of the conventional hermetic compressor described in PTL 1.

FIG. 12 is a schematic view illustrating a structure of refrigeration device 700 according to the seventh exemplary embodiment of the present invention. Refrigeration device 700 is constructed to have hermetic compressor 706 in its refrigerant circuit 705. Hermetic compressor 706 mentioned here is the hermetic compressor described in the fifth or sixth exemplary embodiment. A summary of a basic structure of refrigeration device 700 is provided.

In FIG. 12, refrigeration device 700 includes main body 701, partition wall 704, and refrigerant circuit 705. Main body 701 includes a thermally insulated housing having an opening in one side, and an openable door that closes the opening. Partition wall 704 divides an interior of main body 701 into storage space 702 for articles and machine chamber 703. Refrigerant circuit 705 cools inside of storage space 702.

Refrigerant circuit 705 has hermetic compressor 706 described in the fifth or sixth exemplary embodiment, radiator 707, decompression device 708, and heat absorber 709 that are connected in a loop by piping.

Heat absorber 709 is disposed in storage space 702 equipped with a blower (not illustrated). Cooling heat of heat absorber 709 is agitated by the blower to circulate inside storage space 702 as indicated by dashed arrows.

Hermetic compressor 706 described in the fifth or sixth exemplary embodiment of the present invention is mounted in refrigeration device 700 described above. This hermetic compressor enables operation of the refrigerant circuit with improved reliability and efficiency because its mechanical loss reducing effect is obtained by reduction of shaft diameters of its crankshaft while bearing strength and mechanical strength of the crankshaft are ensured. Consequently, the refrigeration device has improved reliability and enables reduction in power consumption, thus realizing energy saving.

Since the hermetic compressor of the fifth or sixth exemplary embodiment can be reduced in height, a space for mounting the hermetic compressor can be reduced accordingly. Consequently, the refrigeration device can have a larger storage capacity.

As described above, refrigeration device 700 of the present exemplary embodiment includes refrigerant circuit 705 having hermetic compressor 706, radiator 707, decompression device 708, and heat absorber 707 that are connected in the loop by piping, and hermetic compressor 706 is the hermetic compressor of the fifth or sixth exemplary embodiment. By being mounted with hermetic compressor 706 having the improved efficiency, refrigeration device 700 can have its power consumption reduced, thus realizing the energy saving. Hermetic compressor 706 also has the improved reliability. Accordingly, refrigeration device 700 can have its reliability improved. The storage capacity of refrigeration device 700 can be increased by mounting hermetic compressor 706 that is reduced in total height.

INDUSTRIAL APPLICABILITY

As described above, a hermetic compressor of the present invention can have both improved reliability and efficiency with its hermetic container reduced in total height. Thus, the present invention finds its application that is not limited to household appliances such as an electric refrigerator and an air conditioner but is widely applicable to refrigeration devices such as a commercial showcase and an automatic vending machine.

REFERENCE MARKS IN THE DRAWINGS

101 hermetic container
102 electric motor element
103 compression element
104 compressor body
105 suspension spring
106 refrigerant gas
107 lubricating oil
108 suction pipe
109 discharge pipe
110 crankshaft
111 cylinder block
112 piston
113 connecting rod
114 eccentric shaft
**114*a*** cylindrical surface
115 main shaft
**115*a*** cylindrical surface
116 flange
117 oil supply mechanism
**117*a*** groove
118 communicating oil supply passage
**118*a*** opening
119 main shaft oil supply passage
**119*a*** opening
120 eccentric shaft oil supply passage
**120*a*** opening
121 plug
122 compression chamber
123 cylinder bore
**123*a*** opening end
124 bearing
125 thrust surface
126 thrust ball bearing
127 piston pin
128 rod part
129 big end hole
130 small end hole
131 valve plate
132 cylinder head
133 stator
134 rotor
200 refrigeration device
201 main body
202 storage space
203 machine chamber
204 partition wall
205 refrigerant circuit
206 hermetic compressor
207 radiator
208 decompression device
209 heat absorber

317 communicating oil supply passage
317*a* opening
310 crankshaft
320*b* base
321 oil supply mechanism
321*a* groove
400 refrigeration device
401 main body
402 storage space
403 machine chamber
404 partition wall
405 refrigerant circuit
406 hermetic compressor
407 radiator
408 decompression device
409 heat absorber
501 hermetic container
502 electric motor element
503 compression element
504 compressor body
505 suspension spring
506 refrigerant gas
507 lubricating oil
508 suction pipe
509 discharge pipe
510 crankshaft
511 cylinder block
512 piston
513 connecting rod
514 eccentric shaft
514*a* cylindrical surface
515 main shaft
515*a* cylindrical surface
516 flange
518 main shaft oil supply route
519 eccentric shaft oil supply route
520 main shaft oil supply passage
520*a* opening
521 eccentric shaft oil supply passage
521*a* opening
522 communicating oil supply passage
522*a* opening
523 component
524 compression chamber
525 cylinder bore
525*a* opening end
526 bearing
527 thrust surface
528 thrust ball bearing
529 piston pin
530 valve plate
531 cylinder head
532 stator
533 rotor
540 rod part
541 big end hole
542 small end hole
610 crankshaft
614 eccentric shaft
614*a* cylindrical surface
615 main shaft
615*a* cylindrical surface
616 flange
617 oil supply mechanism
618 main shaft oil supply route
619 eccentric shaft oil supply route
620 main shaft oil supply passage
621 eccentric shaft oil supply passage
622 communicating oil supply passage
622*a* opening
623 component
634 non-eccentric shaft side oil supply passage
634*a* opening
700 refrigeration device
701 main body
702 storage space
703 machine chamber
704 partition wall
705 refrigerant circuit
706 hermetic compressor
707 radiator
708 decompression device
709 heat absorber

The invention claimed is:

1. A hermetic compressor accommodating, in a hermetic container, an electric motor element and a compression element driven by the electric motor element, wherein the compression element comprises:

a crankshaft including a main shaft, an eccentric shaft, and a flange;

a cylinder block having a cylinder bore passing through the cylinder block in a cylindrical shape;

a piston configured to reciprocate in the cylinder bore;

a connecting rod connecting the piston and the eccentric shaft; and a bearing formed on the cylinder block, for pivotally supporting a radial load that acts on the main shaft of the crankshaft, and the crankshaft further includes:

a communicating oil supply passage in the flange;

a main shaft oil supply passage communicating between the communicating oil supply passage and a cylindrical surface of the main shaft; and an eccentric shaft oil supply passage communicating between the communicating oil supply passage and a cylindrical surface of the eccentric shaft, wherein the communicating oil supply passage has an opening in an eccentric direction of the flange, and the opening is closed with a plug.

2. The hermetic compressor according to claim 1, wherein the main shaft oil supply passage and the eccentric shaft oil supply passage have respective openings that are provided on the respective cylindrical surfaces to each be other than a region of a bearing load.

3. The hermetic compressor according to claim 1, wherein the hermetic compressor is driven by an inverter at a plurality of operating frequencies.

4. A refrigeration device comprising a refrigerant circuit including: the hermetic compressor according to claim 1; a radiator; a decompression device; and a heat absorber, the hermetic compressor, the radiator, the decompression device, and the heat absorber being connected in a loop by piping.

5. The hermetic compressor according to claim 1, wherein the communicating oil supply passage opens in a direction opposite to the eccentric shaft.

6. The hermetic compressor according to claim 5, wherein the main shaft oil supply passage and the eccentric shaft oil supply passage have respective openings that are provided on the respective cylindrical surfaces to each be other than a region of a bearing load.

7. The hermetic compressor according to claim 5, wherein the communicating oil supply passage includes a side connecting with the eccentric shaft oil supply passage, and the side connecting with the eccentric shaft oil supply passage is positioned at a lower level than a position where the communicating oil supply passage opens in the flange.

8. The hermetic compressor according to claim 5, wherein the eccentric shaft oil supply passage includes a base positioned at a lower level than the communicating oil supply passage.

9. The hermetic compressor according to claim 5, wherein the hermetic compressor is driven by an inverter at a plurality of operating frequencies.

10. A refrigeration device comprising a refrigerant circuit including: the hermetic compressor according to claim 5; a radiator; a decompression device; and a heat absorber, the hermetic compressor, the radiator, the decompression device, and the heat absorber being connected in a loop by piping.

11. A hermetic compressor accommodating, in a hermetic container, an electric motor element and a compression element driven by the electric motor element, wherein the compression element comprises:

a crankshaft including a main shaft, an eccentric shaft, and a flange;

a cylinder block having a cylinder bore passing through the cylinder block in a cylindrical shape;

a piston configured to reciprocate in the cylinder bore;

a connecting rod connecting the piston and the eccentric shaft; and a bearing formed on the cylinder block, for pivotally supporting a radial load that acts on the main shaft of the crankshaft, wherein the compression element further comprises:

a main shaft oil supply route in a shaft center part of the main shaft, the main shaft oil supply route reaching the flange; and an eccentric shaft oil supply route in a shaft center part of the eccentric shaft, the eccentric shaft oil supply route reaching the flange, a main shaft oil supply passage that communicates between the main shaft oil supply route and a cylindrical surface of the main shaft, an eccentric shaft oil supply passage that communicates between the eccentric shaft oil supply route and a cylindrical surface of the eccentric shaft, and a communicating oil supply passage that communicates between the main shaft oil supply route and the eccentric shaft oil supply route, wherein the communicating oil supply passage in the flange has an opening on a side opposite to the eccentric shaft.

12. The hermetic compressor according to claim 11, wherein the main shaft oil supply passage and the eccentric shaft oil supply passage have respective openings that are provided on the respective cylindrical surfaces to each be other than a region of a bearing load.

13. The hermetic compressor according to claim 11, wherein the main shaft oil supply route includes a viscosity pump.

14. The hermetic compressor according to claim 13, wherein the viscosity pump is formed of an inner circumferential surface of the main shaft oil supply route, and a spiral groove formed in an outer circumferential surface of a component provided inside the main shaft oil supply route.

15. The hermetic compressor according to claim 11, wherein the hermetic compressor is driven by an inverter at a plurality of operating frequencies.

16. A refrigeration device comprising a refrigerant circuit including: the hermetic compressor according to claim 11; a radiator; a decompression device; and a heat absorber, the hermetic compressor, the radiator, the decompression device, and the heat absorber being connected in a loop by piping.

17. A hermetic compressor accommodating, in a hermetic container, an electric motor element and a compression element driven by the electric motor element, wherein the compression element comprises:

a crankshaft including a main shaft, an eccentric shaft, and a flange;

a cylinder block having a cylinder bore passing through the cylinder block in a cylindrical shape;

a piston configured to reciprocate in the cylinder bore;

a connecting rod connecting the piston and the eccentric shaft; and a bearing formed on the cylinder block, for pivotally supporting a radial load that acts on the main shaft of the crankshaft, wherein the compression element further comprises:

a main shaft oil supply route in a shaft center part of the main shaft, the main shaft oil supply route reaching the flange; and an eccentric shaft oil supply route in a shaft center part of the eccentric shaft, the eccentric shaft oil supply route reaching the flange, a main shaft oil supply passage that communicates between the main shaft oil supply route and a cylindrical surface of the main shaft, an eccentric shaft oil supply passage that communicates between the eccentric shaft oil supply route and a cylindrical surface of the eccentric shaft, and a communicating oil supply passage that communicates between the main shaft oil supply route and the eccentric shaft oil supply route, wherein the communicating oil supply passage in the flange has an opening on a side connecting with the eccentric shaft;

a non-eccentric shaft side oil supply passage is included in the flange, communicates with the main shaft oil supply route and has an opening on a side opposite to the eccentric shaft; and the communicating oil supply passage and the non-eccentric shaft side oil supply passage have different sectional areas.

* * * * *